US012702904B2

(12) United States Patent
Sugimae et al.

(10) Patent No.: US 12,702,904 B2
(45) **Date of Patent: *Aug. 11, 2026**

(54) MULTI-MATERIAL GOLF CLUB HEAD

(71) Applicant: Acushnet Company, Fairhaven, MA (US)

(72) Inventors: Ryuichi Sugimae, San Diego, CA (US); Peter Larsen, San Marcos, CA (US)

(73) Assignee: Acushnet Company, Fairhaven, MA (US)

( * ) Notice: Subject to any disclaimer, the term of this patent is extended or adjusted under 35 U.S.C. 154(b) by 187 days.

This patent is subject to a terminal disclaimer.

(21) Appl. No.: 17/205,678

(22) Filed: Mar. 18, 2021

(65) Prior Publication Data

US 2022/0126175 A1 Apr. 28, 2022

Related U.S. Application Data

(63) Continuation-in-part of application No. 17/205,376, filed on Mar. 18, 2021, now Pat. No. 11,766,592.
(Continued)

(51) Int. Cl.

| | |
|---|---|
| ***A63B 53/04*** | (2015.01) |
| ***A63B 60/00*** | (2015.01) |
| *A63B 53/08* | (2015.01) |

(52) U.S. Cl.
CPC ..... *A63B 53/045* (2020.08); *A63B 53/0437* (2020.08); *A63B 53/0466* (2013.01);
(Continued)

(58) Field of Classification Search
CPC . A63B 53/045; A63B 53/0437; A63B 60/002; A63B 53/0466; A63B 53/0412;
(Continued)

(56) References Cited

U.S. PATENT DOCUMENTS

| | | | |
|---|---|---|---|
| 3,692,306 | A | 9/1972 | Glover |
| 6,354,962 | B1 | 3/2002 | Galloway |

(Continued)

OTHER PUBLICATIONS

Processing of PEEK/PEI Blends for High Performance Composites in Aerospace by Michele Iannone, file:///C:/Users/bpierce/Downloads/Processing%20of%20PEEK-PEI%20Blends%20for%20High%20Performance%20Composites%20in%20Aerospace.pdf , 2019.*

(Continued)

*Primary Examiner* — William M Pierce
(74) *Attorney, Agent, or Firm* — Ryan A. Reis

(57) ABSTRACT

A multi-material golf club head having an improved performance is disclosed. More specifically, the present invention relates to a multi-material golf club head having a metallic frontal portion and a lightweight aft portion with an addition of an internal ribbon support member. The lightweight aft portion could be formed of a multi-layered sandwich material with at least one layer having low damping properties. The present invention may also further be comprised of a weighting mechanism that is accessible via an opening in the lightweight after portion but connects directly to the metallic frontal portion to mitigate any of the structural integrity issues associated with installing weights in a lightweight portion of a golf club head.

9 Claims, 25 Drawing Sheets

Related U.S. Application Data

(60) Provisional application No. 63/119,121, filed on Nov. 30, 2020, provisional application No. 63/112,551, filed on Nov. 11, 2020, provisional application No. 63/106,248, filed on Oct. 27, 2020.

(52) U.S. Cl.
CPC ..... *A63B 60/002* (2020.08); *A63B 53/0412* (2020.08); *A63B 2053/0491* (2013.01); *A63B 53/08* (2013.01); *A63B 2209/02* (2013.01)

(58) Field of Classification Search
CPC ..... A63B 53/08; A63B 2053/0491; A63B 2209/02
See application file for complete search history.

(56) References Cited

U.S. PATENT DOCUMENTS

| | | | | |
|---|---|---|---|---|
| 6,491,592 | B2 | 12/2002 | Cackett | |
| 7,056,228 | B2 | 6/2006 | Beach | |
| 7,556,567 | B2 | 7/2009 | Galloway | |
| 7,790,637 | B2 * | 9/2010 | DiFonzo | B32B 5/26 442/179 |
| 7,993,216 | B2 * | 8/2011 | Lee | A63B 53/0466 473/345 |
| 8,425,349 | B2 | 4/2013 | Dawson | |
| 8,460,123 | B1 * | 6/2013 | Demille | A63B 60/00 473/347 |
| 8,529,370 | B1 * | 9/2013 | Galloway | A63B 53/0466 473/347 |
| 8,951,143 | B2 | 2/2015 | Morales | |
| 8,979,671 | B1 | 3/2015 | DeMille | |
| 9,033,822 | B1 * | 5/2015 | DeMille | A63B 60/00 473/347 |
| 9,427,631 | B1 * | 8/2016 | Larson | A63B 60/50 |
| 9,868,036 | B1 * | 1/2018 | Kleinert | A63B 53/06 |
| 10,035,049 | B1 * | 7/2018 | Nielson | A63B 60/52 |
| 10,105,579 | B1 | 10/2018 | DeMille | |
| 10,576,335 | B2 * | 3/2020 | Greaney | B32B 5/26 |
| 10,874,914 | B2 * | 12/2020 | Johnson | A63B 60/50 |
| 11,213,726 | B2 * | 1/2022 | Greaney | A63B 53/0466 |
| 11,331,548 | B2 * | 5/2022 | Johnson | A63B 60/52 |
| 2019/0100623 | A1 * | 4/2019 | Geng | C08J 5/043 |
| 2020/0023247 | A1 * | 1/2020 | Larsen | A63B 53/0466 |
| 2022/0032338 | A1 * | 2/2022 | Lynn | C09D 7/67 |
| 2022/0126175 | A1 * | 4/2022 | Sugimae | A63B 53/0466 |
| 2022/0126176 | A1 * | 4/2022 | Sugimae | A63B 53/0437 |

OTHER PUBLICATIONS

Advances in Ultrasonic Welding of Thermoplastic Composites: A Review, Materials, MDPI, https://pdfs.semanticscholar.org/e449/0c3561876fd1e603d95bfa62b1546bf67356.pdf, Mar. 2020.*

ScienceDirect, Handbook of Plastics Joining (Second Edition)—Chapter 29—Polyetherimide, https://www.sciencedirect.com/science/article/pii/B9780815515814500317, 2009.*

Journal of Applied Polymer Science, Next generation high-performance carbon fiber thermoplastic composites based on polyaryletherketones, https://onlinelibrary.wiley.com/doi/full/10.1002/app.44441, Dustin Veazey et al., Sep. 2016.*

ULTEM PEI Resin, GE PLastics, https://www.emcoplastics.com/assets/pdf/ultem/ULTEM%20Product%20Brochure%20GE.pdf, 2003.*

Applied Science and Manufacturing, vol. 109, pges 75-83, Ultrasonic Welding of Carbon/epoxy and carbon/peek composites through a PEI thermoplastic coupling layer, https://www.sciencedirect.com/science/article/pii/S1359835X18300630, Jun. 2018.*

Composites Science and Technology, Manufacture of a Carbon-Fabric-Reingforced Polyetherimide (CF/PEI) Composite Material, M. Hou, et al., https://www.sciencedirect.com/science/article/pii/S0266353897001176, Jan. 1996.*

DP420, Structural Bonding to Aluminu, Titanium, and Stainless Steel, https://web.archive.org/web/20170712113008/https://mrstueve.weebly.com/uploads/1/3/3/6/13364592/bonding_to_metal.pdf, Jul. 2017.*

* cited by examiner

MULTI-MATERIAL GOLF CLUB HEAD

CROSS-REFERENCE TO RELATED APPLICATIONS

The present application is a Continuation-In-Part (CIP) of U.S. patent application Ser. No. 17/205,376, filed Mar. 18, 2021, which claims the benefit of U.S. Provisional Application Ser. No. 63/106,248 filed on Oct. 27, 2020, U.S. Provisional Application Ser. No. 63/112,551, filed Nov. 11, 2020, and U.S. Provisional Application Ser. No. 63/119,121, filed Nov. 30, 2020, the disclosure of which are all incorporated by reference in their entirety.

FIELD OF THE INVENTION

The present invention relates generally to a multi-material golf club head with improved performance. More specifically, the present invention relates to a multi-material golf club head having a metallic frontal portion and a lightweight aft portion with an addition of an internal ribbon support member. The internal ribbon support member helps significantly improve the structural rigidity of the lightweight aft portion and improve the acoustic performance of the golf club head itself. The present invention may also further be comprised of a weighting mechanism that is accessible via an opening within the lightweight aft portion, but connects directly to the metallic frontal portion to mitigate any of the structural integrity issues associated with installing weights in lightweight portions of a golf club head.

BACKGROUND OF THE INVENTION

The utilization of weighting elements to improve the performance of a golf club head has been known in the industry. U.S. Pat. No. 3,692,306 to Glover filed in 1971 shows one of the earliest golf club with a weighting mechanism. Using different material with inherently different density and weighting properties allows the performance of the golf club head to be improved.

Modern day golf club heads, especially metalwood type golf club heads have continuously improved upon the ability to utilize weighting to improve the performance of a golf club head. U.S. Pat. No. 8,951,143 to Morales et al. illustrated one of the more modern ideas that taught a weight attachment mechanism wherein a weight member is coupled with a bracket.

The issues of adding weights to a golf club head becomes even more complicated when a lightweight composite material is used to form a portion of a golf club head. Lightweight composite materials, although very strong in an orientation that is perpendicular to their fibers, can often be weak when subjected to forces in alternate orientations. Hence, adding weighting to a lightweight composite golf club head can often be difficult. U.S. Pat. No. 8,979,671 to DeMille et al. illustrates one of the solutions to address this issue, by strengthening the material around the weight and adding additional support members.

Hence it can be seen there is a need in the industry to create a golf club that utilizes a lightweight composite aft body that is capable of sufficient structural rigidity, good sounds, and good performance.

Additionally, the addition of the thickness of the material to strengthen the material around the weight and the addition of support members can create the undesirable effect of adding in weight at locations that is not desirable. Hence, based on the above, there exists a need to help improve upon the weight attachment mechanism of a golf club head that has a lightweight second material to form a portion of the golf club head itself, without any of the negative side effects associated with traditional methods.

BRIEF SUMMARY OF THE INVENTION

One aspect of the present invention is a golf club head comprising of a frontal striking face portion having one or more threaded receptacles and an aft body attached to the rear of the frontal striking face portion. The aft body portion further comprises of a lightweight shell having one or more weight openings, and internal ribbon support member that attaches to an internal surface of the lightweight shell around a skirt of the lightweight shell, wherein the internal ribbon support member further comprises a secondary wall, separating an internal overall volume of the golf club head into a frontal volumetric chamber and a rear volumetric chamber, wherein the golf club head has a Volumetric Ratio of between about 12.6 to about 19.1. The Volumetric Ratio is defined as:

$$\text{Volumetric Ratio} = \frac{\text{Frontal Volumetric Chamber Volume}}{\text{Rear Volumetric Chamber Volume}}.$$

In another aspect of the present invention is a golf club head comprising of a frontal striking face portion having one or more threaded receptacles and an aft body attached to the rear of the frontal striking face portion. The aft body portion further comprises of a lightweight shell having one or more weight openings, and internal ribbon support member that attaches to an internal surface of the lightweight shell around a skirt of the lightweight shell, wherein the internal ribbon support member further comprises a secondary wall, separating an internal overall volume of the golf club head into a frontal volumetric chamber and a rear volumetric chamber wherein the golf club head has a frontal volumetric chamber that comprises of between about 82% to about 91% of the internal overall volume of the golf club head.

In another aspect of the present invention is a golf club head comprising of a frontal striking face portion having one or more threaded receptacles and an aft body attached to the rear of the frontal striking face portion. The aft body portion further comprises of a lightweight shell having one or more weight openings, and internal ribbon support member that attaches to an internal surface of the lightweight shell around a skirt of the lightweight shell, wherein the internal ribbon support member further comprises a secondary wall, separating an internal overall volume of the golf club head into a frontal volumetric chamber and a rear volumetric chamber wherein the golf club head has a frontal volumetric chamber that comprises of between about 82% to about 91% of the internal overall volume of the golf club head and wherein greater than about 15 percent of an overall mass of the golf club head is located rearward of and behind the secondary wall.

In another aspect of the present invention is a golf club head comprising of a frontal striking face portion having one or more threaded receptacles and an aft body attached to the rear of the frontal striking face portion. The aft body portion further comprises of a lightweight shell having one or more weight openings, and internal ribbon support member that attaches to an internal surface of the lightweight shell around a skirt of the lightweight shell, wherein the internal ribbon support member further comprises of a plurality of cutouts, and wherein the internal ribbon support member has a mass of less than about 5.0 grams.

In another aspect of the present invention the internal ribbon support member further comprises of an internal component and an external component.

In another aspect of the present invention, the internal component and the external component combine to form a diamond shaped internal ribbon support member.

In another aspect of the present invention is a golf club head that produces a sound that has a Critical Time $T_{critical}$ of greater than about 0.01 seconds and less than about 0.02 seconds; said Critical Time $T_{critical}$ is defined as the amount of time it take said sound to oscillate from a peak amplitude $A_{max}$ to a point of 10% of said peak amplitude $A_{max}$.

In another aspect of the present invention is a golf club head comprising of a frontal striking face portion having one or more threaded receptacles and an aft body attached to the rear of the frontal striking face portion. The aft body portion further comprises of a lightweight shell having one or more weight openings, and internal ribbon support member that attaches to an internal surface of the lightweight shell around a skirt of the lightweight shell, and one or more screw weights inserted through the one or more weight opening to engage the one or more threaded receptacle, wherein the lightweight shell and the internal ribbon support member are both made from a fiber reinforced polymer.

In another aspect of the present invention is a golf club head comprising of a frontal striking face portion having two or more threaded receptacles, and an aft body portion attached to the rear of the frontal striking face portion. The aft body portion further comprises of a lightweight shell having two or more weigh openings, an internal ribbon support member that attaches to an internal surface of the lightweight shell around a skirt of the lightweight shell, and two or more screw weights inserted through the one or more weight openings to engage the two or more threaded receptacle, wherein the two or more screw weights are separated by a distance of between about 80 mm to about 120 mm.

In another aspect of the present invention the lightweight shell further comprises of a lightweight crown sub-shell that is further comprised of an outer layer, a central layer, and an internal layer, wherein the central layer is made from a polyphenylene sulfide (PPS) material that is a semi-crystalline resin material. And wherein the outer layer and the internal layer are both made from a polyetherimide (PEI) film.

These and other features, aspects and advantages of the present invention will become better understood with reference to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description describes the best currently contemplated modes of carrying out the invention. The description is not to be taken in a limiting sense, but is made merely for the purpose of illustrating the general principles of the invention, since the scope of the invention is best defined by the appended claims.

Various inventive features are described below, and each can be used independently of one another or in combination with other features. However, any single inventive feature may not address any or all of the problems discussed above or may only address one of the problems discussed above. Further, one or more of the problems discussed above may not be fully addressed by any of the features described below.

Figure 1:
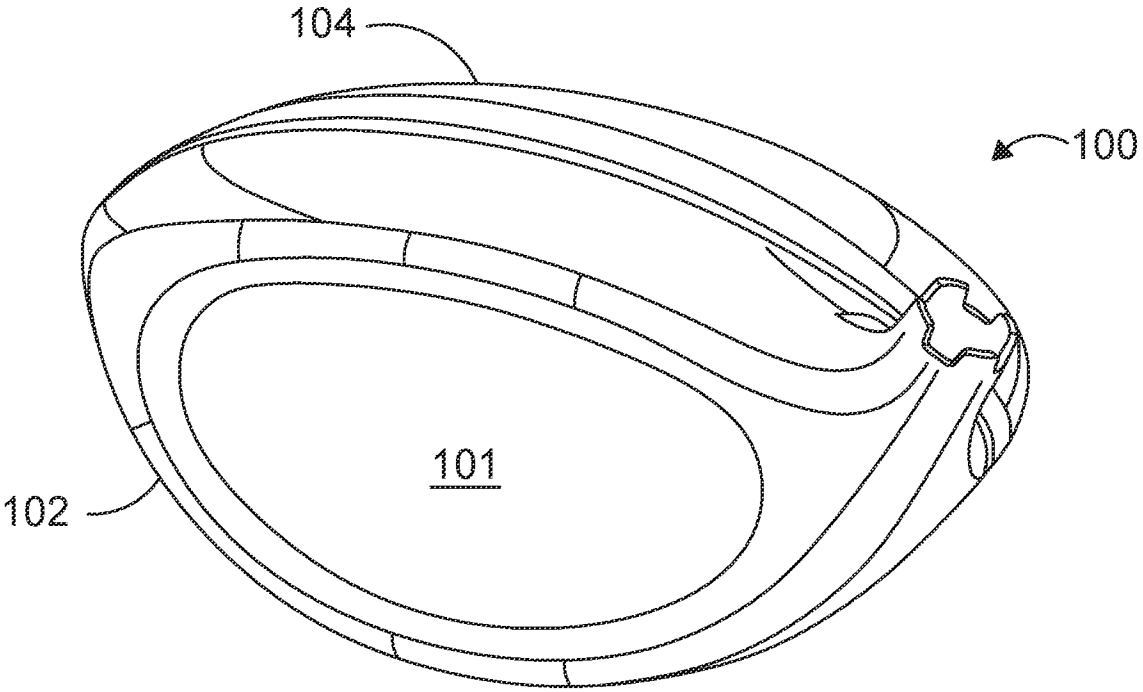
FIG. 1 of the accompanying drawings shows a perspective view of a golf club head in accordance with the present invention.

FIG. 1 of the accompanying drawings shows a perspective view of a golf club head 100 in accordance with an embodiment of the present invention. This perspective view of the present invention, although may not be immediately apparent in this view, shows the golf club head being separated into two major sub-components, a frontal striking face portion 102 having an actual striking face insert 101, and an aft body portion 104. These components are specifically identified because they are generally made from different materials. The frontal striking face portion 102, may generally be made from a metallic material such as titanium, while the aft body portion 104 may generally be made from lightweight material such as a fiber reinforced polymer. More details regarding the fiber reinforced polymer material suitable for this aft body portion 104 may be found in commonly owned U.S. Patent Publication No. 2020/0023247 to Larsen et al. and U.S. Patent Publication No. 2020/0188746 to Sugimae et al., the disclosure of both are incorporated by reference in their entirety.

Figure 2:
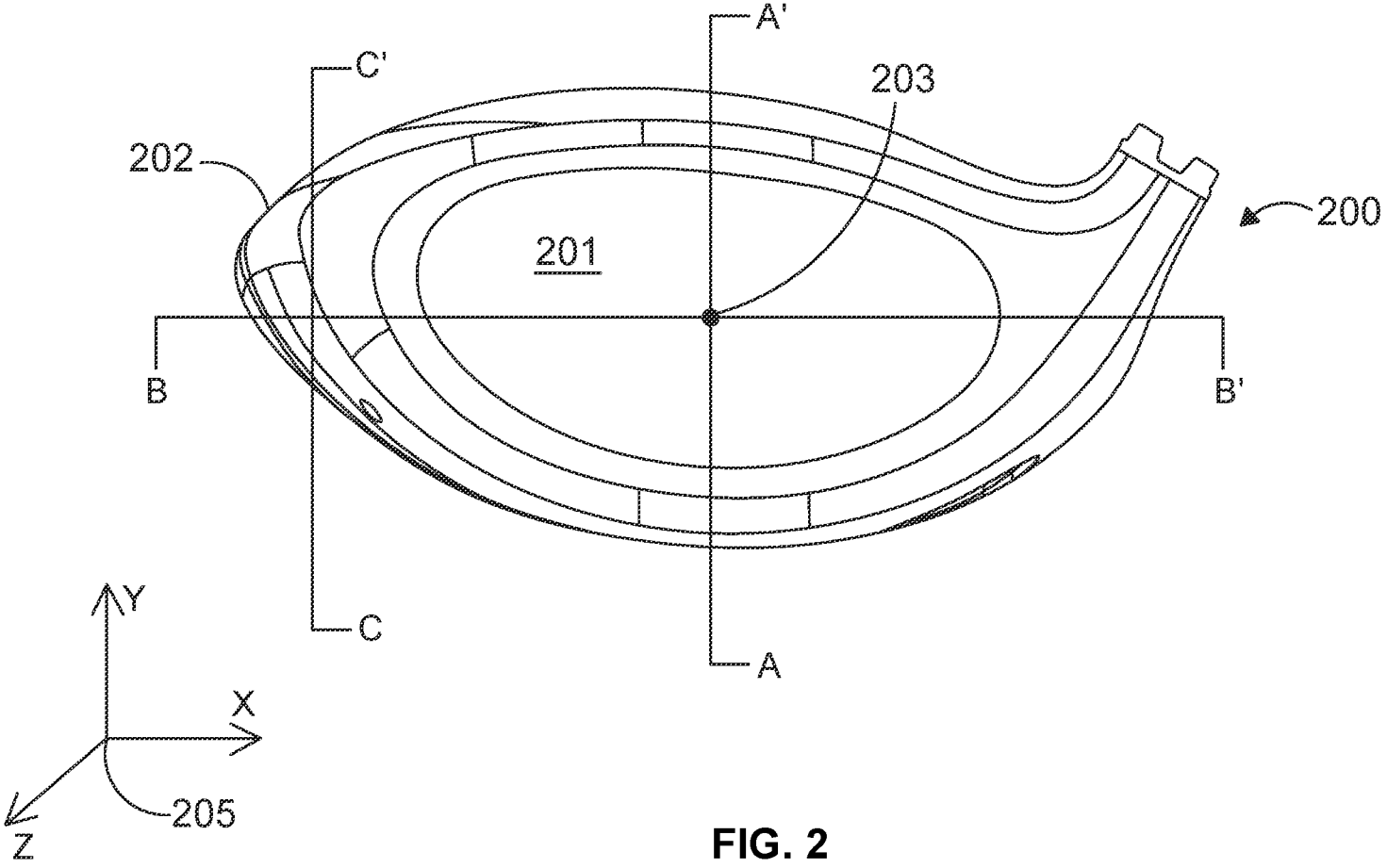
FIG. 2 of the accompanying drawings shows a frontal view of a golf club head in accordance with an embodiment of the present invention.

FIG. 2 of the accompanying drawings shows a frontal view of a golf club head 200 showing that the face insert 201 with a face center 203 being a part of the frontal striking face portion 202. FIG. 2 of the accompanying drawings shows a coordinate system 205 that the present invention uses to help identify the axis. The x-axis is oriented in a heel to toe orientation, with the positive x direction pointing towards the heel of the golf club head 200. The y-axis is oriented in a crown to sole direction, with the positive y-axis pointing towards the crown of the golf club head 200. Finally, the z-axis is orientated in a front to back orientation, with the positive z direction pointing towards the front of the golf club head 200. This frontal view provides some reference point for which subsequent figures may be cross-sectioned. Cross-sectional line A-A' provides the basis of cross-sectioning the golf club head 200 at the face center 203, in a crown to sole direction. Cross-sectional line B-B' provided the basis for cross-sectioning the golf club head 200 at the face center 203, in a heel to toe direction. Finally, Cross-sectional line C-C' provides the basis for cross-sectioning the golf club head 200 along one of the weighting systems unique to the present invention.

Figure 3:
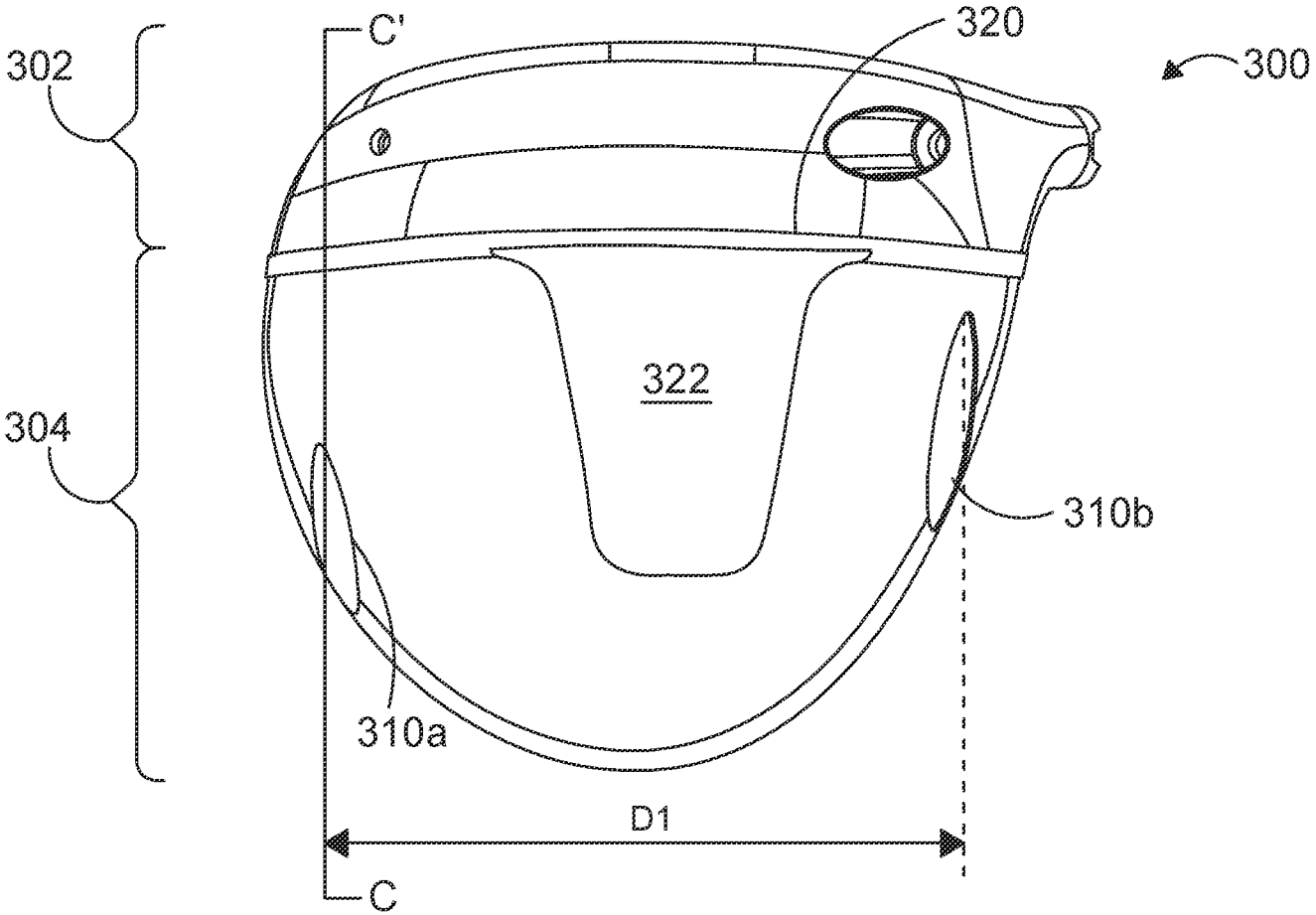
FIG. 3 of the accompanying drawings shows a bottom sole view of a golf club head in accordance with an embodiment of the present invention.

In order to provide more context to the location of cross-sectional line C-C' shown in FIG. 2, the sole view of a golf club head 300 in accordance with an exemplary embodiment of the present invention is shown in FIG. 3. FIG. 3 shows a sole view of a golf club head 300 in accordance with an exemplary embodiment of the present invention, allowing the weight openings 310 to be shown in more detail together with cross-sectional line C-C' passing through the middle of the weight opening 310. More specifically, in this embodiment of the present invention, the golf club head 300 has a toe side weight opening 310*a* and a heel side weight opening 310*b* to allow for multiple weighting systems to be installed in the golf club head 300. In this exemplary embodiment of the present invention, the location of the toe side weight opening 310*a* and heel side weight opening 310*b*, corresponding with the location of the toe side weight 438*a* and heel side weight 438*b* respectively (shown in FIG. 4), may be separated by a distance D1 of between about 80 mm to about 120 mm, more preferably between about 90 mm to about 110 mm, and most preferably about 100 mm. Alternatively, it can said that the location of the toe side screw weight 438*a* and the location of the heel side screw weight 438*b* is separated by a distance D1 of between about 80 mm to about 120 mm, more preferably between about 90 mm to about 110 mm, and most preferably about 100 mm as well. In addition to the above, this sole view of the golf club head 300 also allows a clearer visualization of the separation between the frontal striking face portion 302 and an aft body portion 304. Finally, FIG. 3 of the accompanying drawings shows a joint cover 320 covering the joint between the frontal striking face portion 302 and the aft body portion 304 and a sole plate 322 attached to the sole portion just behind the joint cover 320, the details of both will be shown more clearly in subsequent figures.

Figure 4:
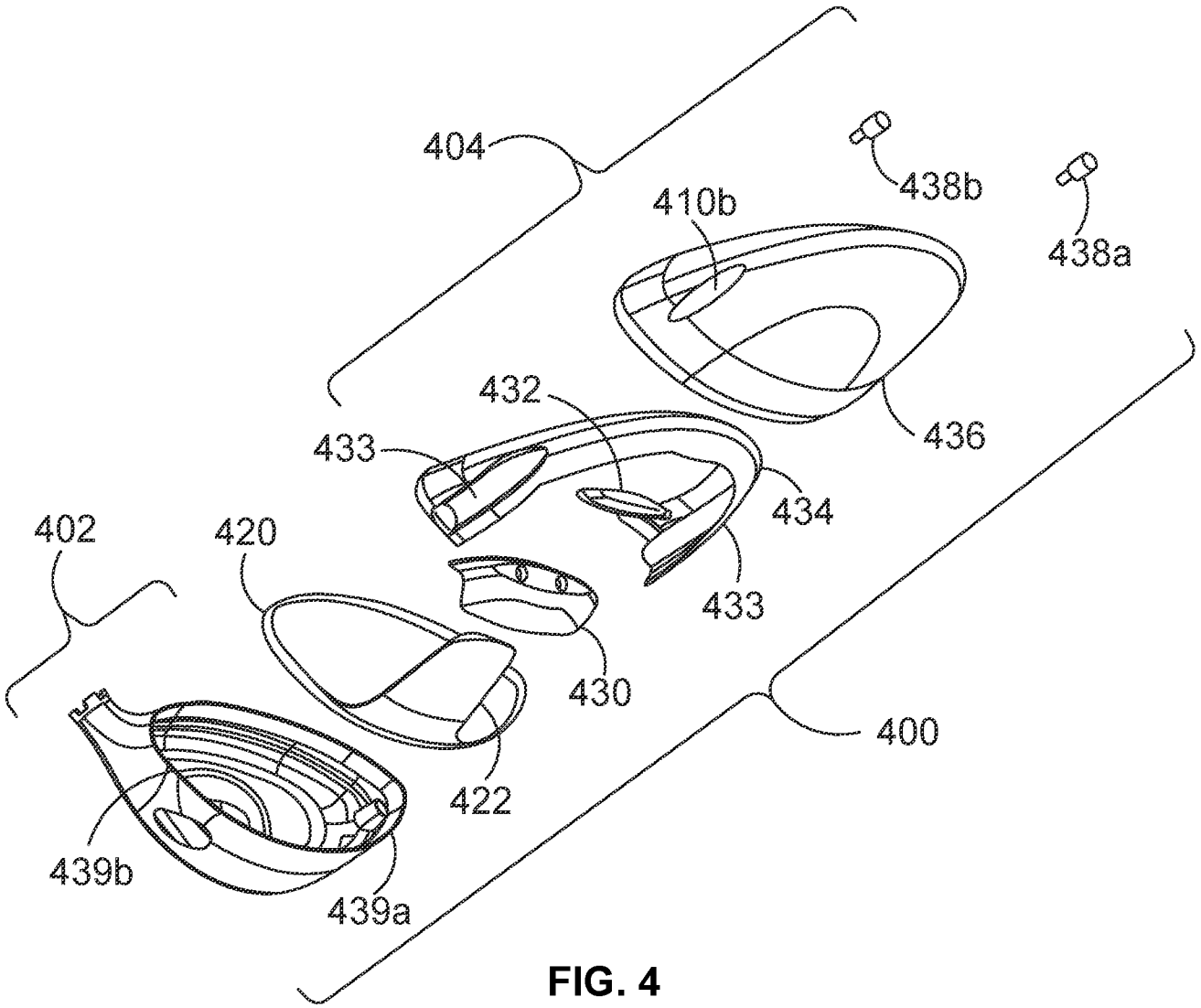
FIG. 4 of the accompanying drawings shows an exploded sole perspective view of a golf club head in accordance with an embodiment of the present invention.

FIG. 4 of the accompanying drawings shows an exploded view of a golf club head 400 in accordance with the present invention. This exploded view not only allows the external components to be shown but allows the internal components and their relationship to the external components to be illustrated as well. Before diving into the details of the specific components, it can be seen here that golf club head 400 is still separated into a frontal striking face portion 402 and an aft body portion 404. The frontal striking face portion may further be comprised of a plurality of threaded receptacles 439 that can be further identified as a toe threaded receptacle 439*a* and a heel threaded receptacle 439*b*. The aft body portion 404 may further be comprised out of an internal weight cover 430, a weighting member 432, an internal ribbon support member 434, a lightweight shell 436 having at least one weight opening 410 (only the heel side weight opening 410*b* is shown in FIG. 4), and two screw weights 438 that can be further identified as a toe screw weight 438*a* and a heel screw weight 438*b*.

It should be noted here that the screw weight 438 of the present invention, although spatially appears at the rear end of the golf club head 400 by being inserted into the weight opening 410 on the lightweight shell 436 of the aft body portion 404, actually engages a threaded receptacle 439 located on the frontal striking face portion 402. The method of attachment here is critical to the proper functioning of the present invention, as it addresses some of the major drawbacks of conventional weight attachment mechanisms. Traditionally, due to the utilization of lightweight materials to form the lightweight shell 436, it is difficult to attach high density weighting mechanisms directly onto those materials, as those materials are not strong enough to endure the vibration of high density weights when impacting a golf ball. Alternatively, one can attach weights directly onto the generally metallic frontal striking face portion 402, but it may not always be desirable to have the weight located so close to the front of the face. The present invention addresses both of those issues by creating a weight opening 410 in the lightweight shell 436 to which the screw weights 438 can be directly attached to the threaded receptacles 439 in the metallic frontal striking face portion 402.

In addition to the above, the exploded view of the golf club head 400 shown in FIG. 4 also shows the joint cover 420 as well as the sole plate 422 to be spatially orientated between the frontal striking face portion 402 and the aft body portion 404 of the golf club head 400 to not only improve the bond between the two components, but also to help protect the aft body portion 404 that tends to be more susceptible to damage when impacting the ground during a golf swing.

Finally, the internal weight cover 430, the weighting member 432, and the internal ribbon support member 434 are also critical to the proper function of the present invention unrelated to the weighting mechanism. Although invisible from the outside, the internal ribbon support member 434 is a critical and one of the most important components to achieve the improved performance of the golf club head 400 in accordance with the present invention. The internal ribbon support member 434 attaches to the internal surface of the lightweight shell 436 around a skirt portion of said lightweight shell 436. The skirt or ribbon of a golf club head 400 is a term of art in the industry that refers to the junction between the crown of the golf club head 400 and the sole of the golf club head 400. The internal ribbon support member 434, as shown in this current embodiment of the present invention, may generally also be made from fiber reinforced polymer, which can be either glued or diffusion bonded to the lightweight shell 436. However, it should be noted that the internal ribbon support member 434 can be made out of alternate material that is either lightweight or non-lightweight all without departing from the scope and content of the present invention, as long as it is capable of increasing the structural rigidity of the aft body portion 404. The internal ribbon support member has at least four identifiable benefits in that it 1) allows the weighting member 432 to be secured to the rear of the lightweight shell 436, 2) improves the bond between the frontal striking face portion 402 and the aft body portion 404, 3) increases structural rigidity of the aft body portion to prevent failure when a fiber reinforced polymer is used to form the lightweight shell 436, and 4) enhances the sound characteristics of the golf club head 400 when it contacts a golf ball.

First, the internal ribbon support member 434 allows the weighting member 432 to be properly secured to the lightweight shell 436 of the aft body portion 404 of the golf club head 400. The weighting member 432 in this embodiment is located at the rearmost portion of the golf club head 400 to help improve the moment of inertia of the golf club head 400. This weighting member 432, generally made out of a high density metallic material such as tungsten, may generally need to be bonded to the lightweight shell 436 via glue, especially if the lightweight shell 436 is made out of fiber reinforced polymer as these types of golf club heads 400 generally are. In order to address the bonding issue generally occurring when a heavy weighting member 432 is attached to a fiber reinforced polymer, an internal weight cover 430 may be used to help secure the weighting member 432 is secured to the lightweight shell 436. Finally, due to the fact that the thickness of the lightweight shell 436 being extremely thin to save weight, combined with the geometry of the lightweight shell 436 at the rear of the golf club head 400 converging into a small edge, the structural rigidity of the lightweight shell 436 at the rear of the golf club head 400 may generally not be strong enough to support the vibration and movement of a high density weighting member 432 experiences when a golf club head 400 impacts a golf ball. In order to address this issue, the present invention includes an internal ribbon support member 434, generally made to be slightly thicker, to further help the structural rigidity of the golf club head 400 around the portion of the weighting member 432. The present invention does this by installing the internal ribbon support member 434 around the internal ribbon portion of the lightweight shell 436, thus providing a more robust are for which the high density weighting member 432 and the weight cover 430 to be attached to.

Secondly, in addition to providing additional structural rigidity to the lightweight shell 436 relating to weight retention as mentioned above, the internal ribbon support member 434 provides even more benefit in helping the entire golf club head 400 stay together by providing support to the entirety of the aft body portion 404. Increasing the structural rigidity of the entirety of the aft body portion 404 is just as important, if not more important, than the weight retention feature of the internal ribbon support member 434. Lightweight shells 436, as previously stated, is generally made from fiber reinforced polymer. Fiber reinforced polymer materials, for starters, can't be directly bonded to a metallic material without the need of an adhesive. Adhesively bonded materials can generally come lose when either of the bonded materials vibrate and move too much, which fiber reinforced polymers tend to do when subject to high impact forces. This movement of the material can often make it difficult to bond to solid metallic structures such as the titanium frontal striking face portion 402 to a fiber reinforced polymer aft body portion 404, thus creating a significant design challenge. In order to address this issue, the internal ribbon support member 434 provides a solid surface around which the lightweight shell 436 may bond to, thus reducing vibration of the parts, hence increasing the bond between the frontal striking face portion 402 and the aft body portion 404 that's often achieved via glue.

As a side note, the previously mentioned joint cover 420 also helps with the bond between the frontal striking face portion 402 and the aft body portion 404 by increasing the structural rigidity of the bond area. The joint cover 420, although made out of the same fiber reinforced polymer in this embodiment, may be made out of any alternate material that can be glued to the external surface of the bond region to improve structural rigidity all without departing from the scope and content of the present invention.

Thirdly, as a corollary to the ability of the structural rigidity of the aft body portion's 404 ability to bond to a metallic frontal striking face portion 402; the same type of undesirable movement that prohibits proper bonding between the frontal striking face portion 402 and the aft body portion 404 could cause the lightweight shell 436 to fail when subjected to high impact forces. The present invention's utilization of the internal ribbon support member 434 also helps address the issue of the ability of the lightweight shell 436, that is made out of a thin fiber reinforced polymer material, to withstand the impact forces of a golf club head 400 with a golf ball. The internal ribbon support member 434 achieves this by strengthening the weak areas of the lightweight shell 436 that can often vibrate more than normal upon impact with a golf ball, thus preventing the lightweight shell 436 that is made from a fiber reinforced polymer from cracking or delaminating.

Figure 5:
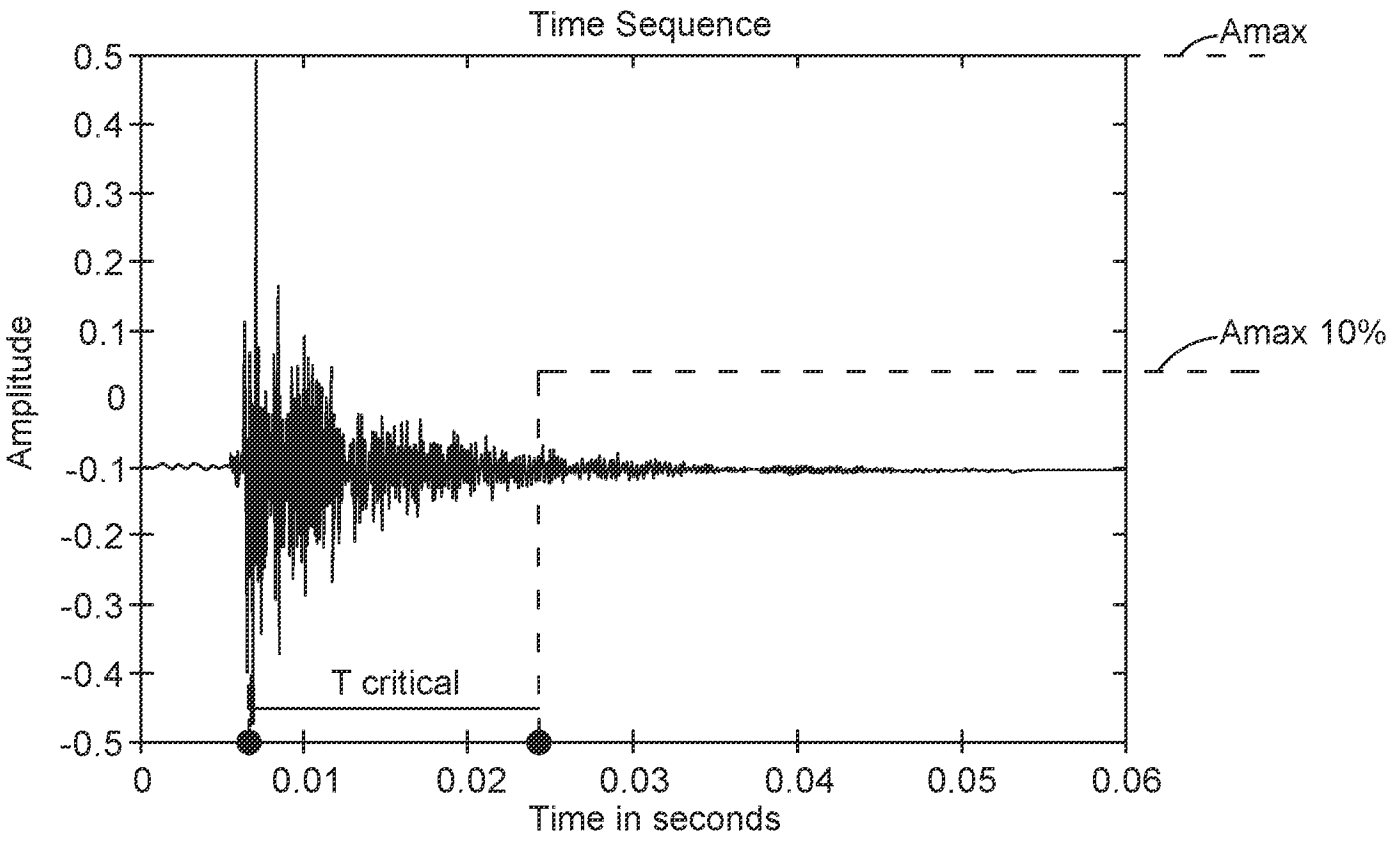
FIG. 5 of the accompanying drawings shows a time sequence diagram representing the amplitude of the sound of a golf club head in accordance with an embodiment of the present invention.

Fourthly, and finally, the addition of the internal ribbon support member 434 improves the acoustic of the golf club head 400, as golf clubs that have a significant portion made purely out of thin fiber reinforced polymer may result in an undesirable sound. For a more detailed discussion regarding the sound in a golf club head, including the methodology to test for sounds, please refer to commonly owned U.S. Pat. No. 10,653,927 to Murphy et al., the disclosure of which is incorporated by reference in its entirety. In summary, it can be said that the internal ribbon support member 434 allows the present golf club head 400 to achieve similar desirable sound characteristics as the golf club in U.S. Pat. No. 10,653,927 described. Referring to FIG. 5 of the accompanying drawings, it can be said that the current golf club head exhibits a time it takes for the sound amplitude to oscillate from the peak amplitude $A_{max}$ to an amplitude that is 10% of peak amplitude Amax is defined as the Critical Time $T_{critical}$, and is generally greater than about 0.01 seconds and less than about 0.02 seconds, more preferably greater than about 0.015 seconds and less than about 0.02 seconds, and most preferably greater than about 0.0175 seconds and less than about 0.02 seconds. In addition to the above, the current inventive golf club head 400 may, due in major part to the addition of the internal ribbon support member 434, generally have its own resonate frequency of greater than 3300 kHz, more preferably greater than 3400 kHz, and most preferably greater than 3500 kHz, all without departing from the scope and content of the present invention.

It should also be noted here that the internal ribbon support member 434 may also further comprise out of two recesses 433, to which they engage the two or more weight openings 410 to create a space that allows the screw weights 438 to engage the threaded receptacles 439.

Finally, the internal ribbon support member 434, in its current embodiment as shown, may generally have a total mass of between about 3.7 grams and about 4.1 grams, more preferably between about 3.8 grams and about 4.0 grams, and most preferably about 3.9 grams. However, it should be noted that the mass of the internal ribbon support member 434 is also critical to the proper functionality of the present golf club head 400, as an internal ribbon support member 434 that is too robust and heavy may place weight at undesirable locations of the golf club head 400, while the mistake of making that same internal ribbon support member 434 too flimsy and lightweight may not offer sufficient structural support to the golf club head 400 itself to achieve the desired result.

Figure 6:
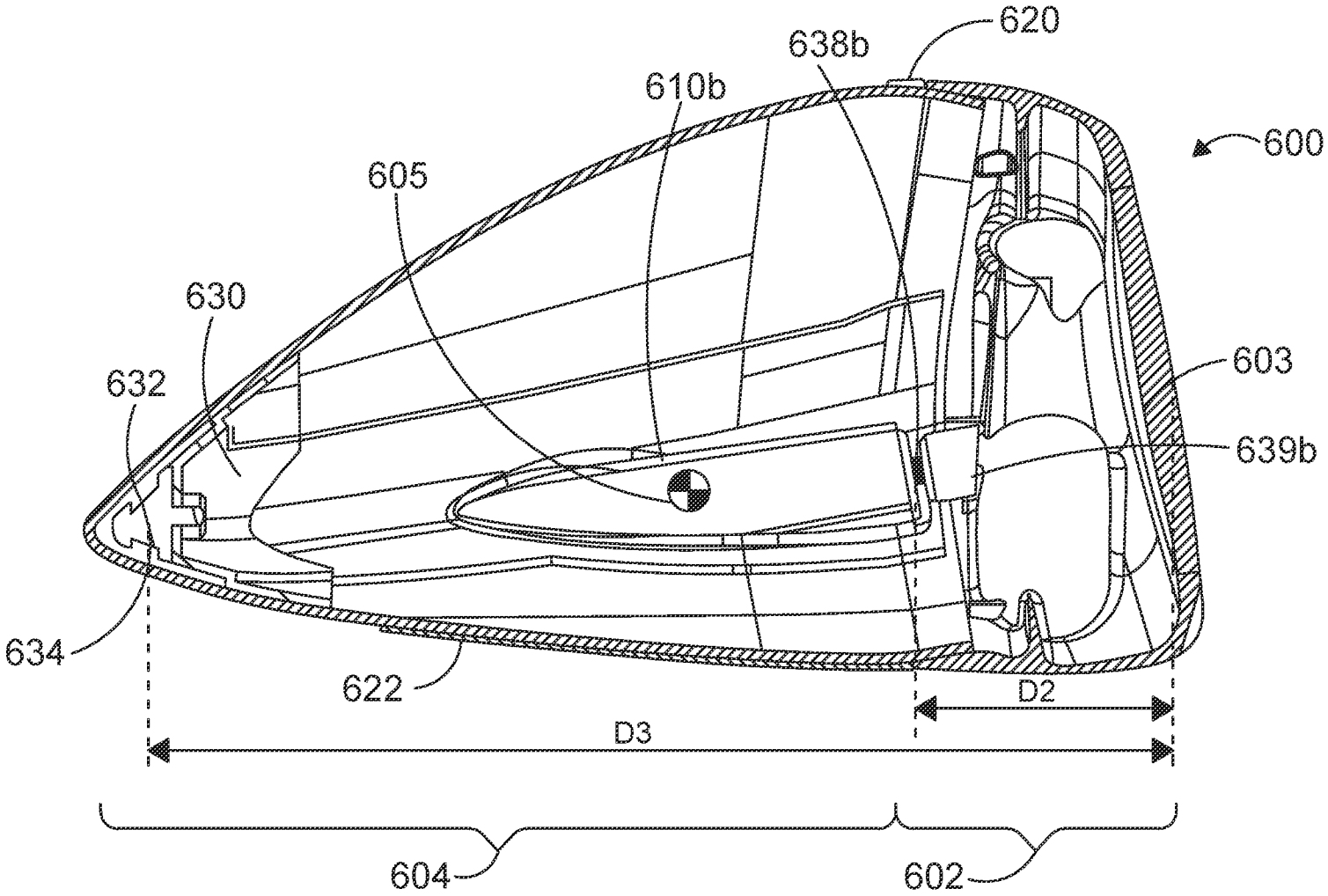
FIG. 6 of the accompanying drawing shows a cross-sectional view of a golf club head in accordance with an embodiment of the present invention taken along cross-sectional line A-A' shown in FIG. 2.

FIG. 6 of the accompanying drawings shows a cross-sectional view of a golf club head 600 in accordance with an embodiment of the present invention, taken along cross-sectional line A-A' shown in FIG. 2. This cross-sectional view of the golf club head 600 allows the relationship between the various components to be shown more clearly in an assembled state, which sheds more lights on the inner workings of the current inventive golf club head 600. Similar to previous discussions, FIG. 6 consists mainly of a frontal striking face portion 602 and an aft body portion 604. The frontal striking face portion 602 has a threaded receptacle 639, more specifically, only the heel threaded receptacle 639*b* is shown due to the cross-section only showing the heel side of the golf club head 600. Attached to the rear of the frontal striking face portion 602 is the aft body portion 604 that's mainly made from a lightweight material generally unsuitable for direct weight attachment.

Relating to the weighting mechanism, FIG. 6 of the accompanying drawings shows the aft body portion 604 having a heel weight opening 610*b* that allows the heel screw weight 638*b* to mechanically secure the aft body portion 604 to the frontal striking face portion 602. The location of the heel screw weight 638*b*, and the non-illustrated toe screw weight 638*a* may be located at a distance D2 of between about 25 mm and about 35 mm rearward of the face center 603, more preferably between about 27 mm and about 33 mm rearward of the face center 603, and most preferably between about 28 mm and about 32 mm rearward of the face center 603. This cross-sectional view of the golf club head 600 shown here also shows the weighting member 632 being sandwiched between the internal weight cover 630 and the internal ribbon support member 634 to help retain it. The location of the weighting member 632 may be located at a distance D3 of greater than about 100 mm rearward of face center 603, more preferably greater than about 105 mm rearward of face center 603, and most preferably about 110 mm rearward of face center.

The location and existence of the screw weights 638 weighting members 632 allows the current inventive golf club head 600 to have improved center of gravity and moment of inertia properties. More specifically, the golf club head 600 may have a CG depth, in the z-direction as shown in FIG. 2 of greater than about 32 mm, more preferably greater than about 33 mm, and most preferably greater than about 34 mm. Additionally, the current inventive golf club head 600 may have a moment of inertia about a y-axis as shown in FIG. 2 of greater than about 5,200 g-cm$^2$, more preferably greater than about 5,300 g-cm$^2$, and most preferably greater than about 5,400 g-cm$^2$.

Finally, this cross-sectional view of the golf club head 600 shows how the joint cover 620 wraps around the entire junction between the frontal striking face portion 602 and the aft body portion 604 to eliminate any step in the transition between the two pieces, and the joint cover 620 further includes a sole plate 622 to protect the underside of the golf club head 600 as that portion of the golf club head 600 is more easily prone to being scuffed up when swinging the golf club head 600.

Figure 7:
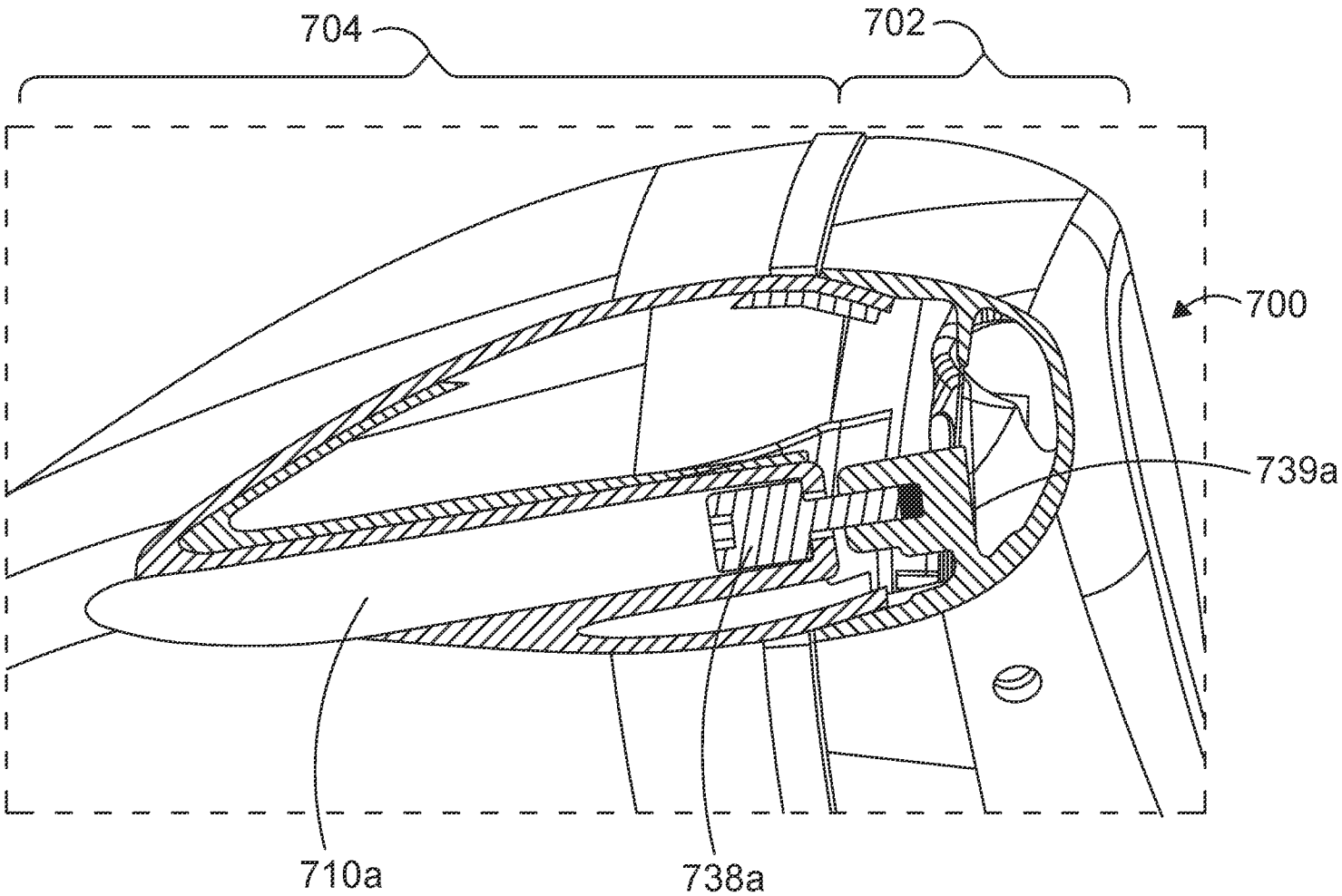
FIG. 7 of the accompanying drawings shows an enlarged cross-sectional view of a golf club head in accordance with an exemplary embodiment of the present invention taken along cross-sectional line C-C' shown in FIG. 2.

FIG. 7 of the accompanying drawings shows an enlarged cross-sectional view of a golf club head 700 taken along cross-sectional line C-C' as shown in FIG. 3. This enlarged cross-sectional view of the golf club head 700 allows the relationship between the weight opening 710, the screw weight 738, and the threaded receptacle 739 to be shown more clearly. Although this cross-sectional view of the golf club head 700 is taken along the toe weight opening 710*a*, the relationship between the various components is the same with respect to the heel side weighting components (not shown in FIG. 7). Although it has been previous foreshadowed that the toe screw weight 738*a* can help mechanically connect the aft body portion 704 to the frontal striking face portion 702, that specific relationship is not specifically illustrated until this FIG. 7. In FIG. 7, the toe weight opening 710*a* has an opening within its terminal end of the recess, which the male threaded portion of the toe screw weight 738*a* protrudes out of to engage a female portion of a threaded toe threaded receptacle 739*a*. Alternatively, it can be said that the diameter of the terminal opening of the toe weight opening 710*a* is smaller than a head diameter of the toe screw weight 738*a*, thus creating the mechanical retention. It should be noted here that although the toe screw weight 738*a* can be used to help further secure the attachment of the aft body portion 704 to the frontal striking face portion 702, the screw need not provide such a mechanical engagement, as will be illustrated in subsequent figures.

Figure 8:
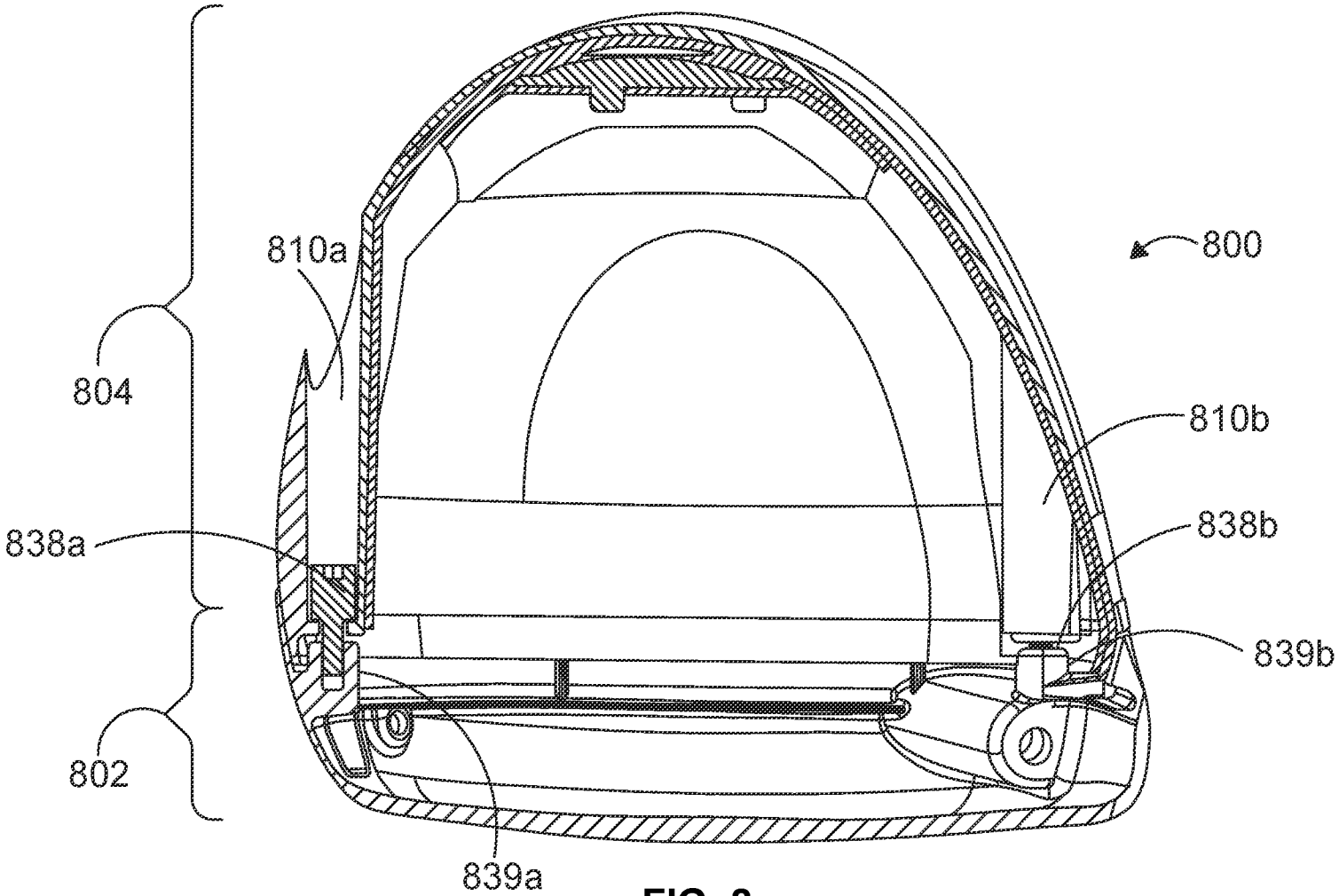
FIG. 8 of the accompanying drawings shows a cross-sectional view of a golf club head in accordance with an exemplary embodiment of the present invention taken along cross-sectional line B-B' shown in FIG. 2.

FIG. 8 of the accompanying drawings shows a cross-sectional view of a golf club head 800 taken across cross-sectional line B-B' shown in FIG. 2. This cross-sectional view of the golf club head allows both sets of the screw weights 838*a* and 838*b* to be shown more clearly. The basic components of the screw weight 838*a* and 838*b*, the threaded receptacle 839*a* and 839*b*, and weight openings 810*a* and 810*b* have all been previously discussed and remains the same in the current embodiment shown in FIG. 8. It should be noted that although the current embodiments of the present invention shows two sets of weighting members, three or more weighting members, or maybe even 1 set of weighting member, may be used without departing from the scope and content of the present invention. Additionally, as the cross-sectional view of the golf club head 800 shows, the height of the toe side weighting members 810*a*, 838*a*, and 839*a* are higher along the y-axis (as previously discussed in FIG. 2) then the than the heel side weighting members 810*b*, 839*b*, and 839*b*. This type of arrangement not only allows for adjustment of the center of gravity of the golf club head 800 in a heel to toe orientation by installing screw weights 838 with mass properties, but this variation in height allows for an adjustment of the center of gravity in a crown to sole direction as well. In this particular embodiment of the present invention, the toe side screw weight 838*a* is located greater than about 8 mm higher than the heel side screw weight 838*b*, more preferably greater than about 9 mm higher than the heel side screw weight 838*b*, and most preferably greater than about 10 mm higher than the heel side screw weight 838*b*. However, it should be noted that in alternative embodiment of the present invention, the toe weighting members 810*a*, 838*a*, and 839*a* may be lower than the heel weighting members 810*b*, 883*b*, and 839*b*, or even be the same height all without departing from the scope and content of the present invention.

Figure 9:
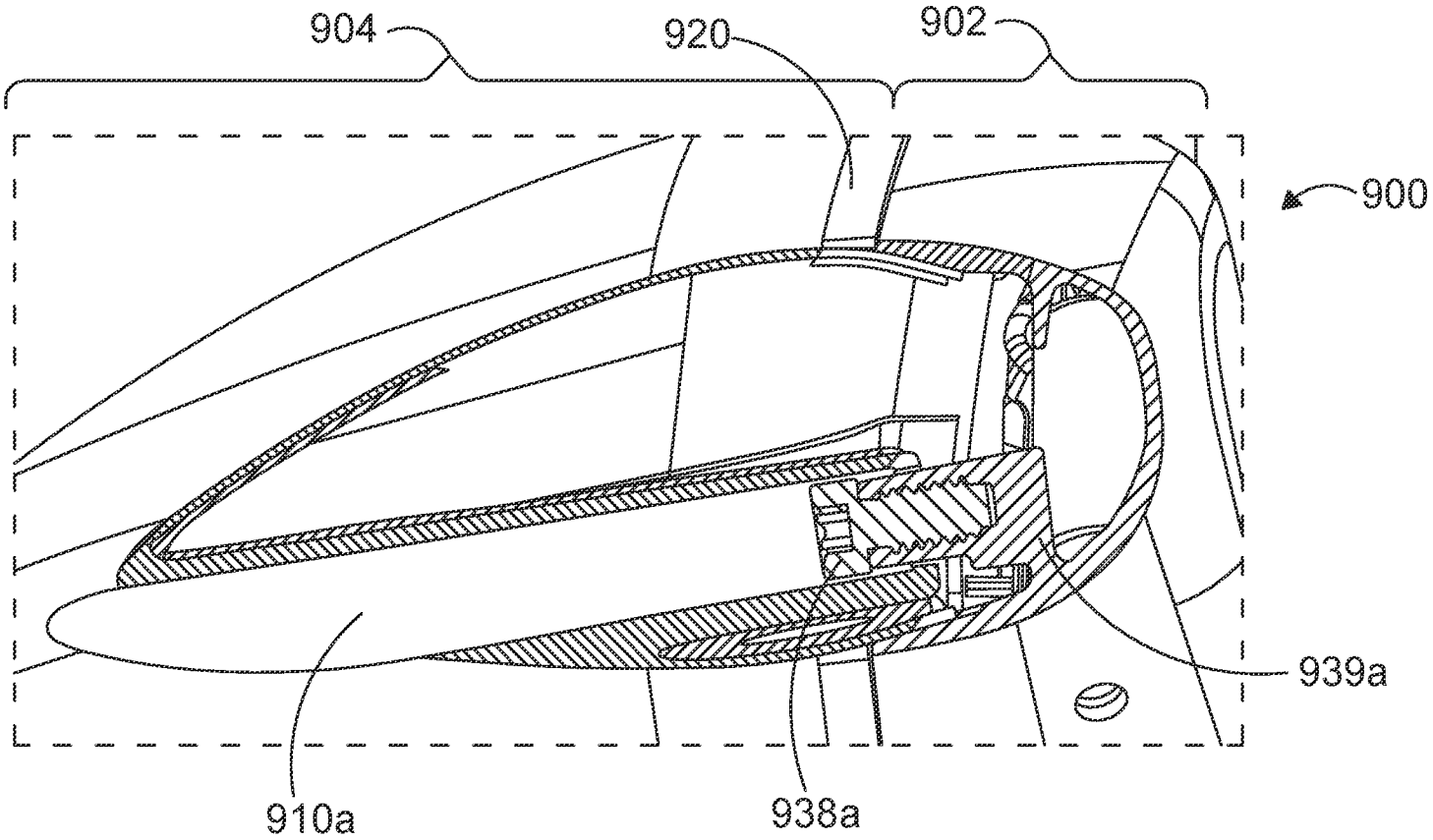
FIG. 9 of the accompanying drawings shows an enlarged cross-sectional view of a golf club head in accordance with an exemplary embodiment of the present invention taken along cross-sectional line C-C' shown in FIG. 2.

FIG. 9 of the accompanying drawings shows an enlarged cross-sectional view of a golf club head 900 in accordance with an alternative embodiment of the present invention. In this alternative embodiment of the present invention, a different screw weighting mechanism is used, and this screw weighting mechanism does not provide any mechanical lock between the frontal striking face portion 902 and the aft body portion 904. The enlarged cross-sectional view of the golf club head 900 illustrates the lack of the overlap between the head of the screw weight 938*a* and the inner wall of the weight opening 910*a*, as the screw weight 938*a* is threaded into the threaded receptacle 939*a*. Alternatively, it can be said that the terminal opening of the weight opening 910*a* may have a diameter that is greater than a head diameter of the screw weight 938*a*. This lack of an overlap means that the screw weight 938*a* is only attached to the frontal striking face portion 902 of the golf club head 900 for the purpose of attaching weight to the golf club head 900, and the bond between the frontal striking face portion 902 and the aft body portion 904 is purely achieved via the joint around the external perimeter joint, in the regions that's covered by the joint cover 920.

Figure 10:
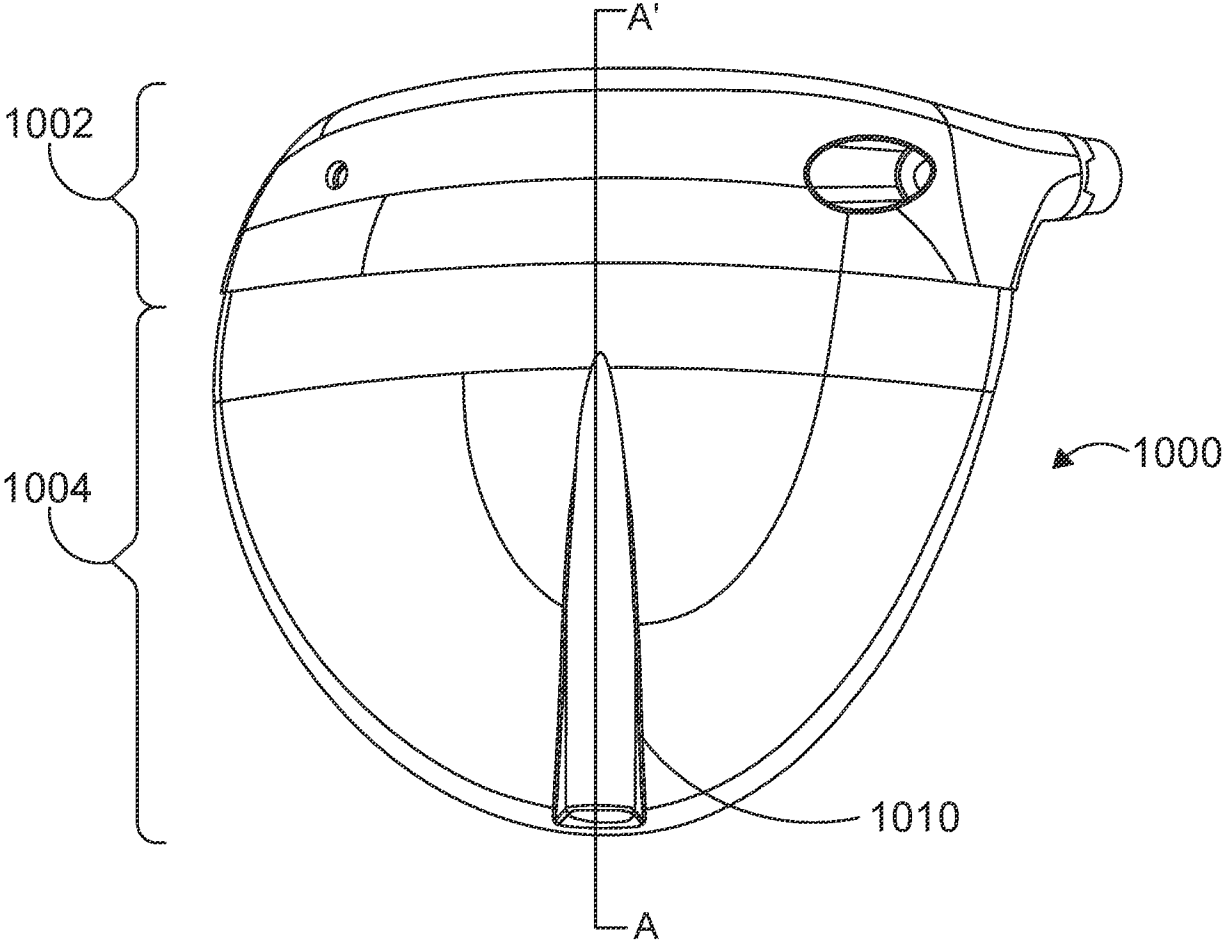
FIG. 10 of the accompanying drawings shows a bottom sole view of a golf club head in accordance with an embodiment of the present invention.
Figure 11:
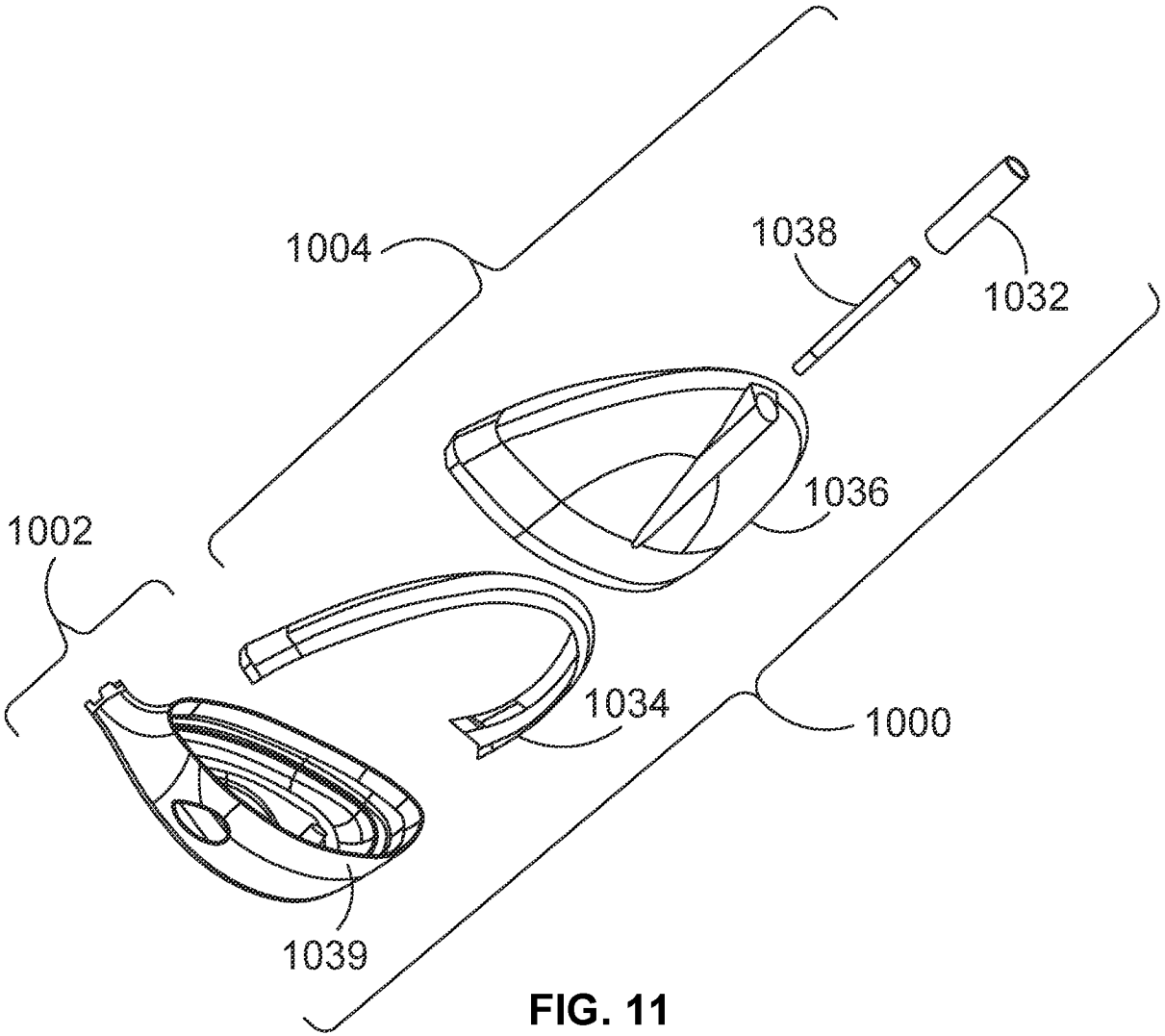
FIG. 11 of the accompanying drawings shows an exploded sole perspective view of a golf club head in accordance with an embodiment of the present invention.
Figure 12:
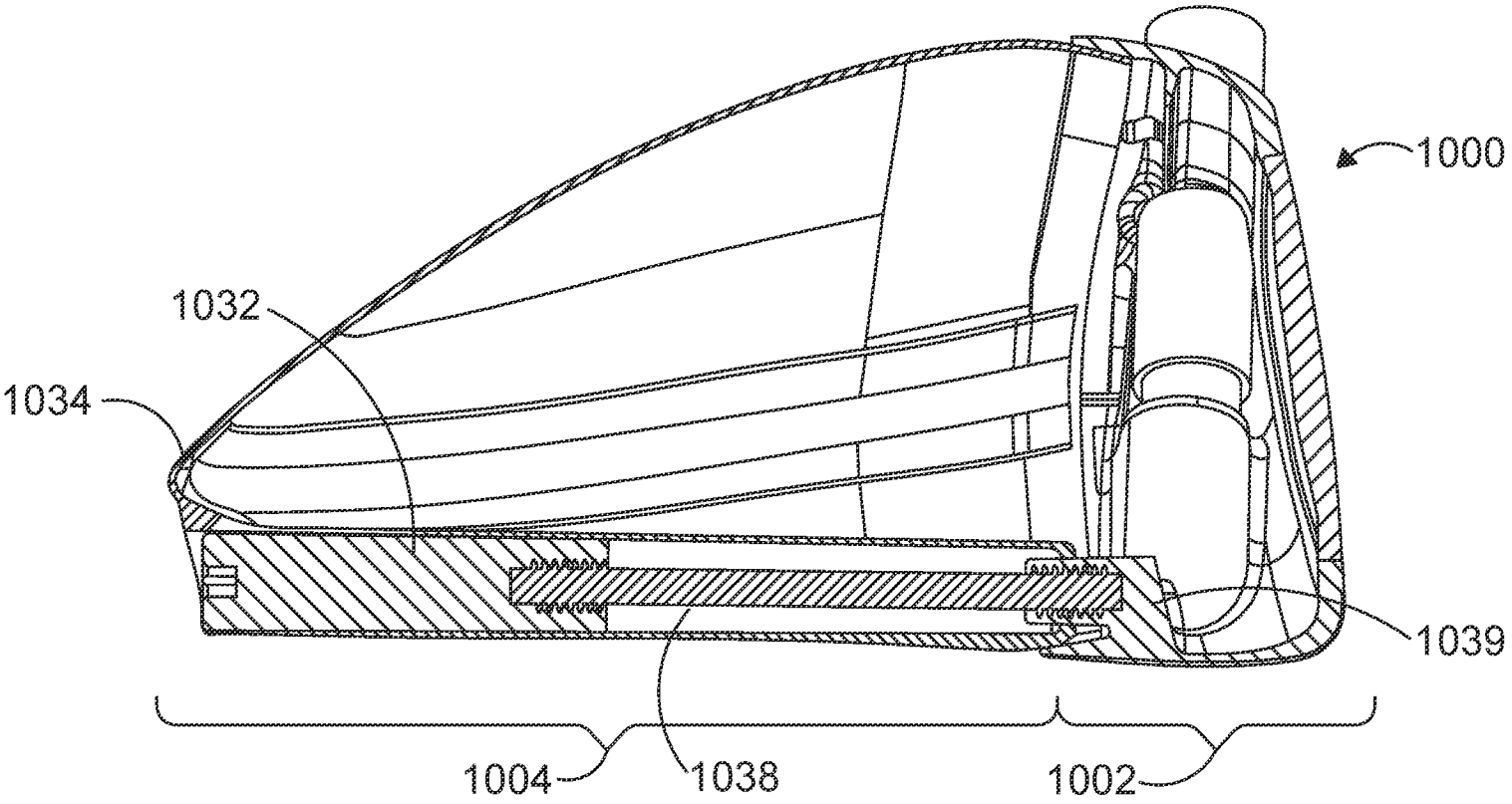
FIG. 12 of the accompanying drawings shows a cross-sectional view of a golf club head in accordance with an embodiment of the present invention taken along cross-sectional line A-A' as shown in FIGS. 2 and 11.

FIGS. 10, 11, and 12 shows a golf club head 1000 in accordance with an alternative embodiment of the present invention, More specifically, FIG. 10 shows a sole view of the golf club head 1000, FIG. 11 shows an exploded perspective view of the golf club head 1000, and FIG. 12 shows a cross-sectional view of the golf club head 1000. Discussing all three of these figures together, we can see that in this embodiment of the present invention, the location of the weight opening 1010 is located near the rear central portion of the aft body portion 1004 of the golf club head 1000 adapted to receive the weighting system previously discussed. This embodiment of the present invention may be preferred when the need for heel to toe weighting adjustment is not needed, and a heavier emphasis is placed on moving the center of gravity rearward in the golf club head 1000. The exploded view of the golf club head 1000 shown in FIG. 11 once again further illustrates the internal ribbon support member 1034 being located in the aft body portion 1004 of the golf club head 1000, which the previous discussion has already shown to provide significant benefits to the present invention. In addition to the above, FIG. 11 also shows the internal components of the screw weight 1038 engaging the threaded receptacle 1039, however, in this embodiment, the weighting member 1032 may be retained via the screw weight 1038 as shown in FIG. 11 instead of being held in place by internal ribbon support member 1034 as shown in previous embodiments.

FIG. 12 showing a cross-sectional view of a golf club head 1000 along cross-sectional line A-A' as shown in FIGS. 2 and 10 allows the newly introduced weighting mechanism to be explained more clearly. In FIG. 12, we can see that the screw weight 1038 helps retain a weighting member 1032 near a rear portion of the golf club head 1000 without actually attaching to the aft body portion 1004. The extra-long screw weight 1038 retains the weighting member 1032 near the rear of the weight opening 1010, and threadedly engages the threaded receptacle 1039 that is located at the metallic frontal striking face portion 1002. Finally, it is worth noting that in this embodiment of the present invention, due to the fact that the head of the screw weight 1038 is located towards the rear of the golf club head 1000, the screw weight 1038 does not help with mechanically securing the aft body portion 1004 to the frontal striking face portion 1002 as some of the earlier embodiments may show.

Figure 13:
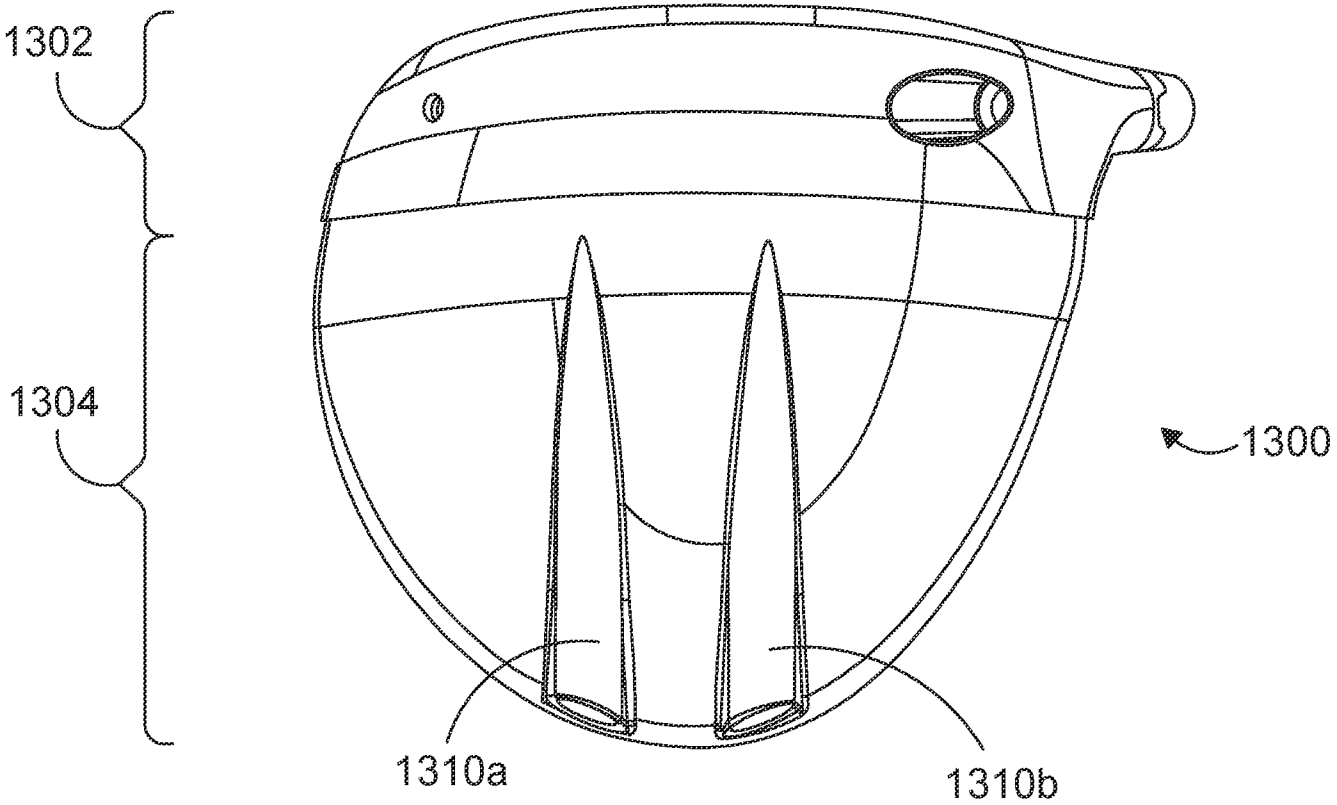
FIG. 13 of the accompanying drawings shows a bottom sole view of a golf club head in accordance with an embodiment of the present invention.

It should be noted here that although FIGS. 10, 11, and 12 shows a golf club head having one weighting systems with one weight opening 1010 located on the rear of the golf club head 1000, two or more weighting systems could be placed at the rear of the golf club head without departing from the scope and content of the present invention as shown in FIG. 13 of the accompanying drawings. FIG. 13 of the accompanying drawings shows a sole view of a golf club head 1300 having a heel weight opening 1310*a* and a toe weight opening 1310*b* capable of incorporating two weighting systems, as these weighting configurations may be desirable in certain situations.

Figure 14:
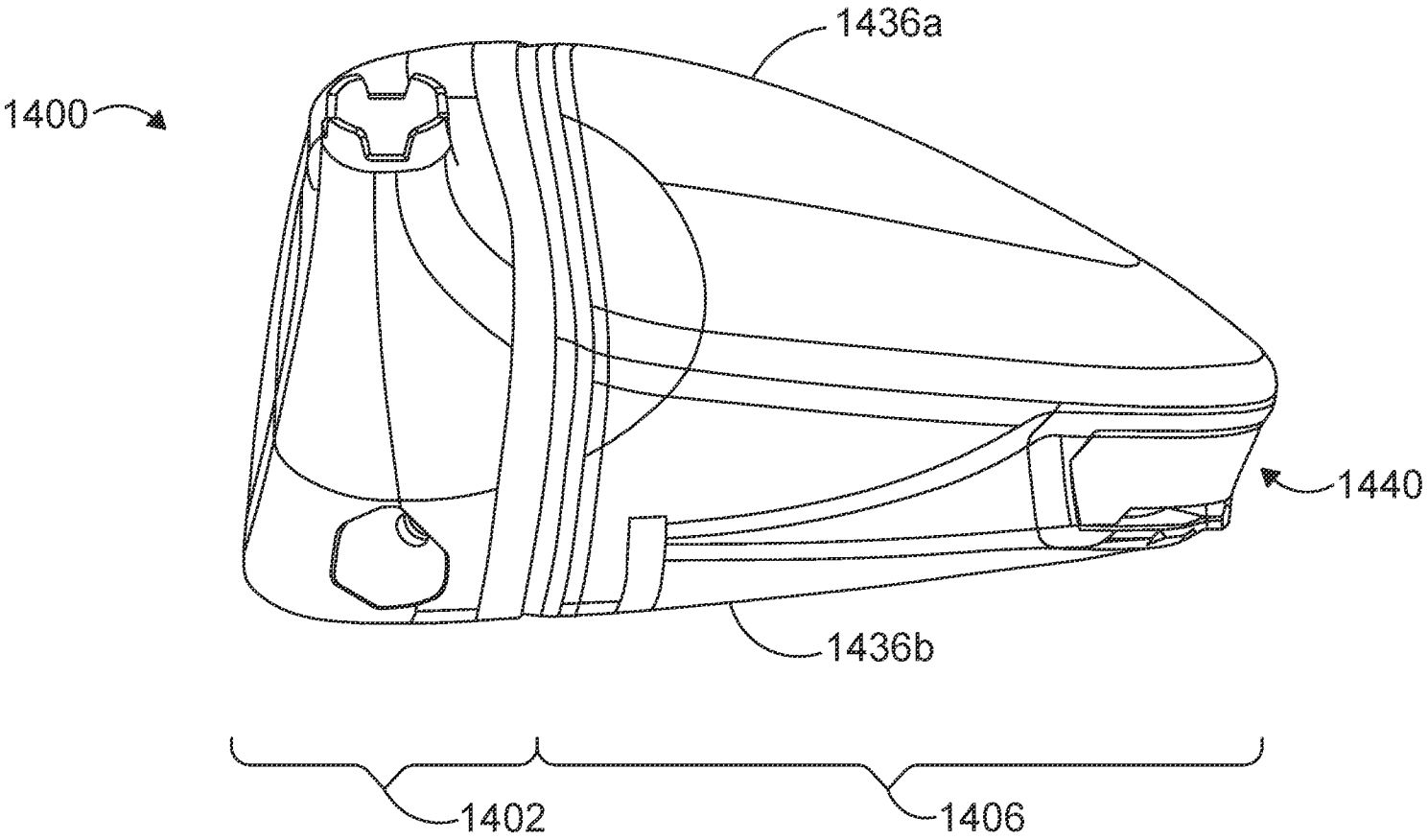
FIG. 14 of the accompanying drawings shows a toe side view of a golf club head in accordance with a further alternative embodiment of the present invention.
Figure 15:
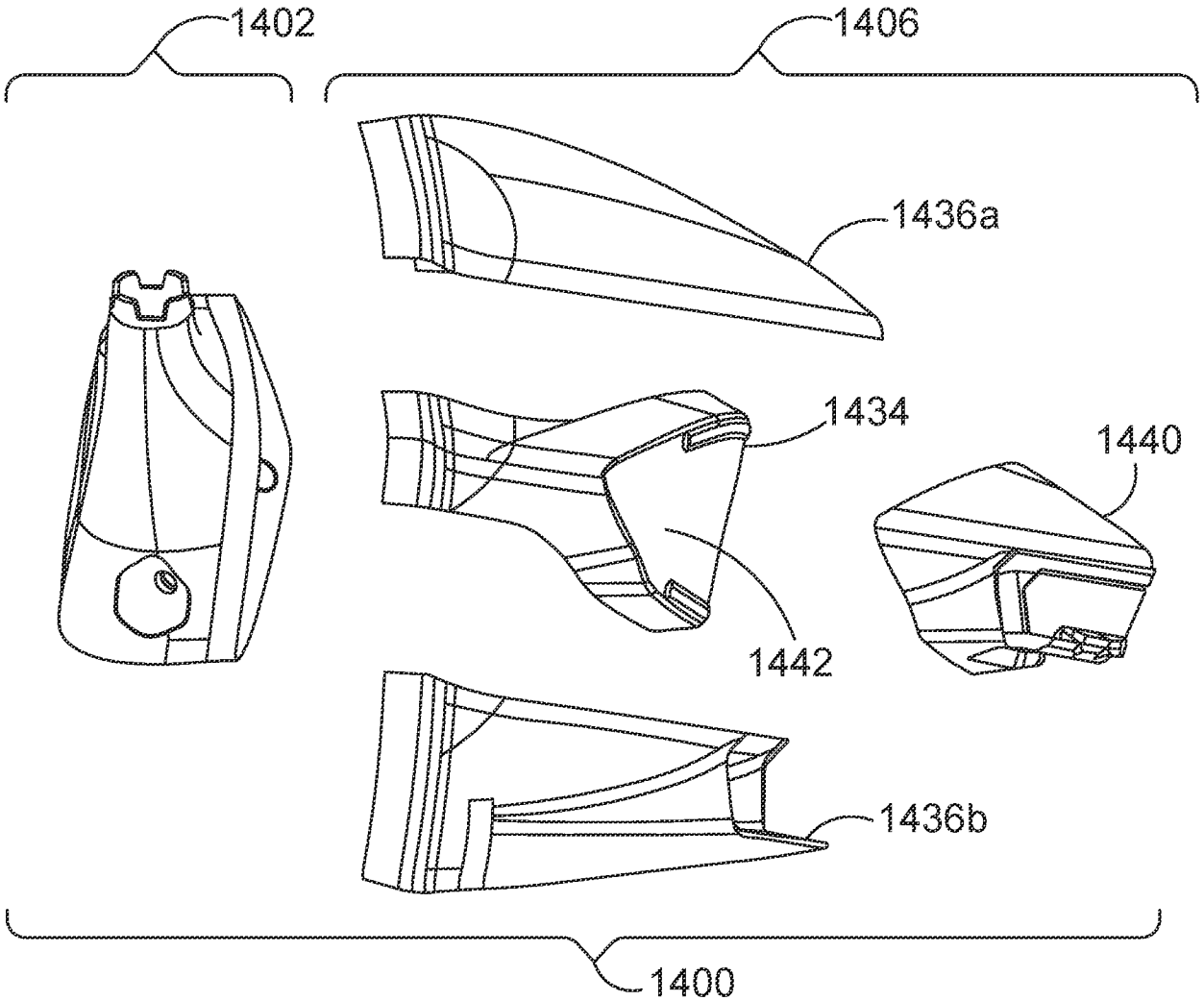
FIG. 15 of the accompanying drawings shows an exploded toe side view of a golf club head in accordance with a further alternative embodiment of the present invention.
Figure 16:
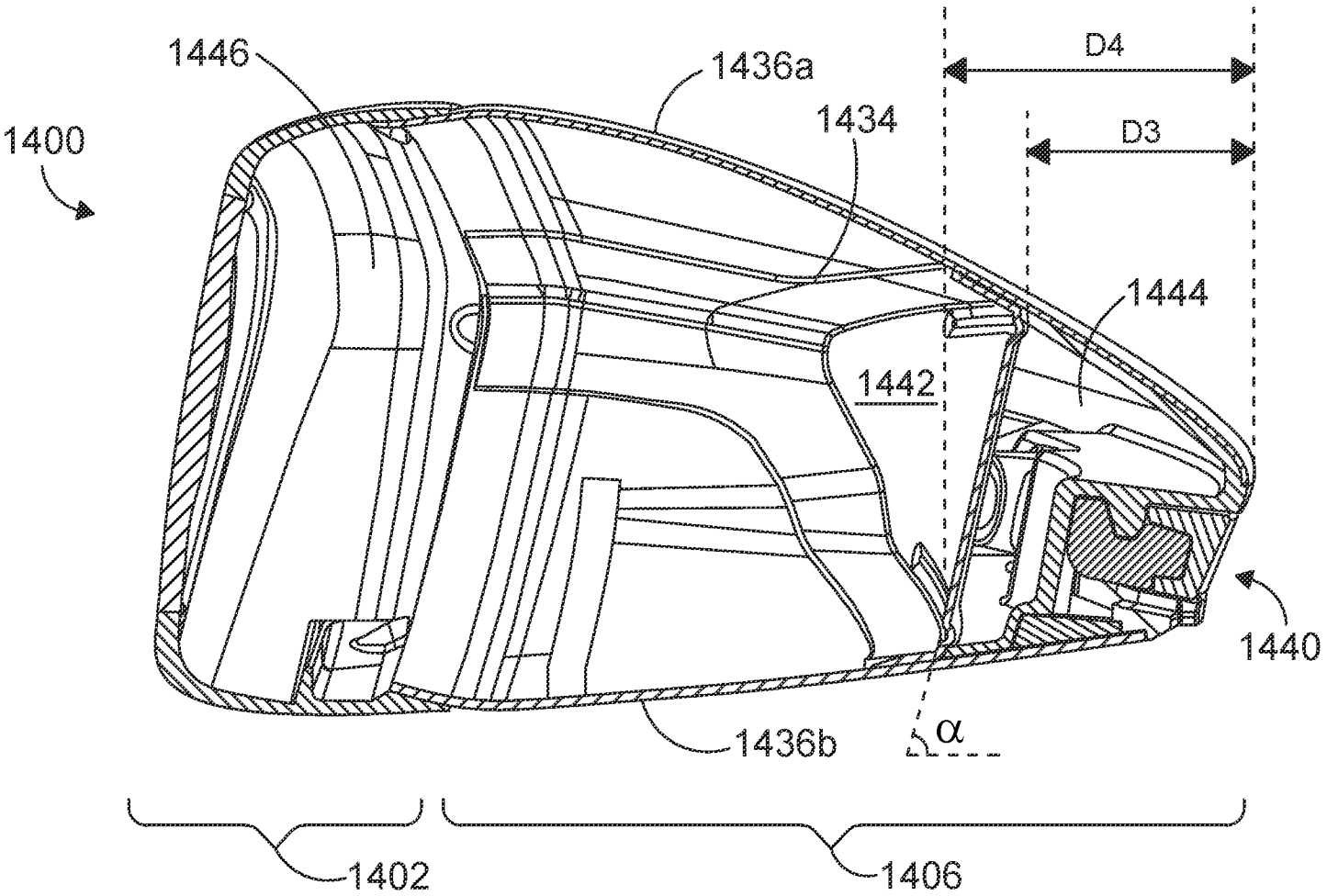
FIG. 16 of the accompanying drawings shows a cross-sectional view of a golf club head in accordance with a further alternative embodiment of the present invention taken along cross-sectional line A-A' as shown in FIGS. 2 and 11.

FIGS. 14 through 16 shows a golf club head 1400 in accordance with a further alternative embodiment of the present invention utilizing a different weighting mechanism that does not directly connect to the frontal striking face portion.

FIG. 14 of the accompanying drawings shows a heel side view of a golf club head 1400 in accordance with this alternative embodiment of the present invention. The golf club head 1400, similar to previous embodiments, all have a frontal striking face portion 1402 and an aft body portion 1406. The aft body portion 1406 in this embodiment may very slightly from the previous embodiments in that it uses multiple pieces to form the lightweight shell 1436, and it has a slightly different weighting system 1440. The details of the weighting system will be discussed later.

The lightweight shell 1436 in this embodiment may be formed out of two different pieces, a lightweight crown sub-shell 1436*a* and a lightweight sole sub-shell 1436*b*, both of which combine to form the lightweight shell 1436. These sub-components may generally be formed independently of one another and joined as separate and individual pieces after they have been formed. It should be noted that since the entirety of the lightweight shell is generally made from a fiber reinforced polymer, the lightweight crown sub-shell 1436*a* and the lightweight sole sub-shell 1436*b* may generally also be formed out of the same fiber reinforced polymer. However, in an alternative embodiment of the present invention, the lightweight crown sub-shell 1436*a* and the lightweight sole shell 1436*b* could each be made out of different fiber reinforced polymer, have only one of the components be made out of a fiber reinforced polymer, or even have both be made out of alternate lightweight materials that's not a fiber reinforced polymer all without departing from the scope and content of the present invention. Combining a lightweight crown sub-shell 1436*a* and a lightweight sole sub-shell 1436*b* to form the lightweight shell 1436 itself may be preferred as these substantially flat sub-components are easier to manufacture. However, when joining multiple sub-component pieces together to form the lightweight shell 1436, the structural integrity of the aft body portion 1406 may suffer, thus making the internal ribbon support member (not shown in FIG. 14) even more critical to the present invention. In order to show the relationship between the various component in accordance with this further alternative embodiment of the present invention, FIG. 15 is provided below.

FIG. 15 of the accompanying drawings shows an exploded toe side view of a golf club head 1400 in accordance with a further alternative embodiment of the present invention. As previously discussed, in this further alternative embodiment of the present invention, the lightweight shell 1436 is split into two sub-components, a lightweight crown sub-shell 1436*a* and a lightweight sole sub-shell 1436*b*, that attaches to one another to form the rear aft body portion 1406. The weighting system 1440 attaches to the rear of the rear aft body portion 1406 by engaging an opening in the lightweight sole sub-shell 1436*b*. Finally, the critical component in the present invention is the internal ribbon support member 1434 shown in the exploded view of the golf club head 1400 in FIG. 15.

The internal ribbon support member 1434 shown in FIG. 15 differs slightly from previous ribbon support member 1434 shown previously in FIG. 4 in that it does not support the entirety of the skirt portion across the entire lightweight shell 1436 because of the existence of the weighting system 1440 located at the rear of the aft body portion 1406. This internal ribbon support member 1434 provides makes up for that lack of connection at the rear of the aft body portion 1406 by creating a secondary wall 1442 that connects the lightweight crown sub-shell 1436*a* with the lightweight sole sub-shell 1436*b* in a y-shaped structure as illustrated in FIG. 15. The secondary wall 1442, despite not contacting the rear skirt portion of the lightweight shell 1436, makes up for that by providing structural rigidity to the lightweight shell 1436 via the connection between the lightweight crown sub-shell 1436*a* and the lightweight sole sub-shell 1436*b*. The secondary wall 1442, as shown in this embodiment of the present invention may generally have a thickness of between about 0.5 mm to about 1.0 mm, more preferably between about 0.6 mm to about 0.9 mm, and most preferably between about 0.7 mm to about 0.8 mm. Although it won't be visible until the cross-sectional view of the golf club head 1400 is provided in FIG. 16, the secondary wall creates two separate volumetric chambers within the golf club head 1400.

Finally, the weighting system 1440 may generally be a weighting system that has a high density weight member made from a metallic material attached to a chassis that is made from a lightweight material. The utilization of the lightweight material may generally be the same type of material as the lightweight shell 1436, however alternative materials may be used for the chassis of the weighting system so long as it is capable of being bonded to the remainder of the rear aft body 1406 all without departing from the scope and content of the present invention.

It should be noted here that a significant portion of the weighting system here in this embodiment is placed behind the secondary wall 1442, and it makes up a significant portion of the overall mass of the golf club head 1400. In this current exemplary embodiment, the mass rearward of and behind the secondary wall 1442 may generally be greater than about 30 grams, more preferably greater than about 35 grams, and most preferably greater than about 40 grams. Alternatively speaking, assuming that the overall golf club head 1400 has a mass of about 200 grams, it can be said that greater than about 15 percent of the overall mass of the golf club head 1400 is located rearward of and behind the secondary wall 1442, more preferably greater than about 17.5 percent of the overall mass of the golf club head 1400 is located rearward of and behind the secondary wall 1442, and most preferably greater than about 20 percent of the overall mass of the golf club head 1400 is located rearward of and behind the secondary wall 1442.

In order to better see the two separate volumetric chambers created by the secondary wall 1442 and the internal workings of the weighting system 1440, a cross-sectional view of this golf club head 1400 in accordance with this further alternative embodiment is provided in FIG. 16. FIG. 16 of the accompanying drawings shows a cross-sectional view of a golf club head 1400 take along a cross-sectional line A-A' show in FIG. 2. In the cross-sectional view of the golf club head 1400 shown in FIG. 16, it can be seen that the secondary wall 1442 separates the golf club head 1400 into two separate volumetric chambers, a frontal volumetric chamber 1446 and a rear volumetric chamber 1444. Because the secondary wall 1442 is located near the rear portion of the golf club head 1400, the frontal volumetric chamber may generally have a volume of between about 380 cc and about 420 cc, more preferably between about 390 cc and about 410 cc, and most preferably about 400 cc. Given that the overall size of a driver type golf club head is has an internal overall volume of about 460 cc, it can also be said that the frontal volumetric chamber comprises of between about 82% to about 91% of the internal overall volume, more preferably between about 84% to about 89% of the internal overall volume, and most preferably about 87% of the internal overall volume. Conversely, the rear volumetric chamber

1444 is created on the other side of the secondary wall 1442. In this embodiment shown, due to the existence of a track based weighting system 1440, the rear volumetric chamber has a volume of between about 22 cc to about 30 cc, more preferably between about 24 cc to about 28 cc, and most preferably about 26 cc. In this embodiment, the rear volumetric chamber comprises of between about 4.7% to about 6.5% of the internal overall volume, more preferably between about 5.2% to about 6.0% of the internal overall volume, and most preferably about 5.6% of the internal overall volume. However, it should be noted that in alternative embodiments of the present invention, the rear volumetric chamber 1444 may have a simple screw weight system, or no weighting system at all, all without departing from the scope and content of the present invention. In those alternative embodiments, the rear volumetric chamber 1444 may have a complimentary volume of about 40 cc to about 80 cc, more preferably between about 50 cc to about 70 cc, and most preferably about 60 cc, resulting in a percentage of between about 9% to about 18%, more preferably between about 11% to about 16%, and most preferably about 13 percent of the internal overall volume respectively all without departing from the scope and content of the present invention.

Based on the numbers and percentages outlined above, it can be said that the golf club head 1400 may have a Volumetric Ratio of between about 12.6 to about 19.1, more preferably between about 13.9 to about 17.1, and most preferably about 15.4 all without departing from the scope and content of the present invention, with the Volumetric Ratio defined by Equation (1) below:

$$\text{Volumetric Ratio} = \frac{\text{Frontal Volumetric Chamber Volume}}{\text{Rear Volumetric Chamber Volume}} \quad \text{Eq. (1)}$$

As a corollary to the volume measurements articulated above, the location of the secondary wall 1442 may also be defined as a measurement from the rearmost point of the golf club head 1400. In the current exemplary embodiment of the present invention, the second wall is angled at an angle $\alpha$ of between about 8° to about 12°, more preferably between about 9° to about 11°, and most preferably about 10° measured from a horizontal ground plane. Resultingly, the upper end of the secondary wall 1442 is located at a distance D3 of between about 20 mm to about 26 mm from the rearmost portion of the golf club head 1400, more preferably between about 21 mm to about 25 mm from the rearmost portion of the golf club head 1400, and most preferably about 23 mm from the rearmost portion of the golf club head 1400. The lower end of the secondary wall 1442 is located at a distance D4 of between about 28 mm to about 34 mm from the rearmost portion of the golf club head 1400, more preferably between about 29 mm to about 33 mm from the rearmost portion of the golf club head 1400, and most preferably about 31 mm from the rearmost portion of the golf club head 1400. Due to the positive angle $\alpha$, the upper end of the secondary wall 1442 is always located closer to the rearmost point of the golf club head 1400. It should be noted that in an alternative embodiment, the angle $\alpha$ could be a negative number, wherein the lower end of the secondary wall 1442 is located closer to the rearmost point of the golf club head 1400 as well, also without departing from the scope and content of the present invention. Thus, regardless of whether the angle $\alpha$ is positive or negative, it can be said that no portion of the secondary wall 1442 is located within 26 mm from the rearmost portion of the golf club head 1400, more preferably no portion of the secondary wall 1442 is located within 25 mm from the rearmost portion of the golf club head 1400, and most preferably no portion of the secondary wall 1442 is located within 23 mm from the rearmost portion of the golf club head 1400.

Finally, the cross-sectional view of golf club head 1400 shown in FIG. 16 illustrates a track type weighting system 1440. More details regarding this type of track type weighting system 1440 may be found in commonly owned U.S. Pat. No. 10,695,628 to Yi et al., the disclosure of which is incorporated by reference in its entirety.

Figure 17:
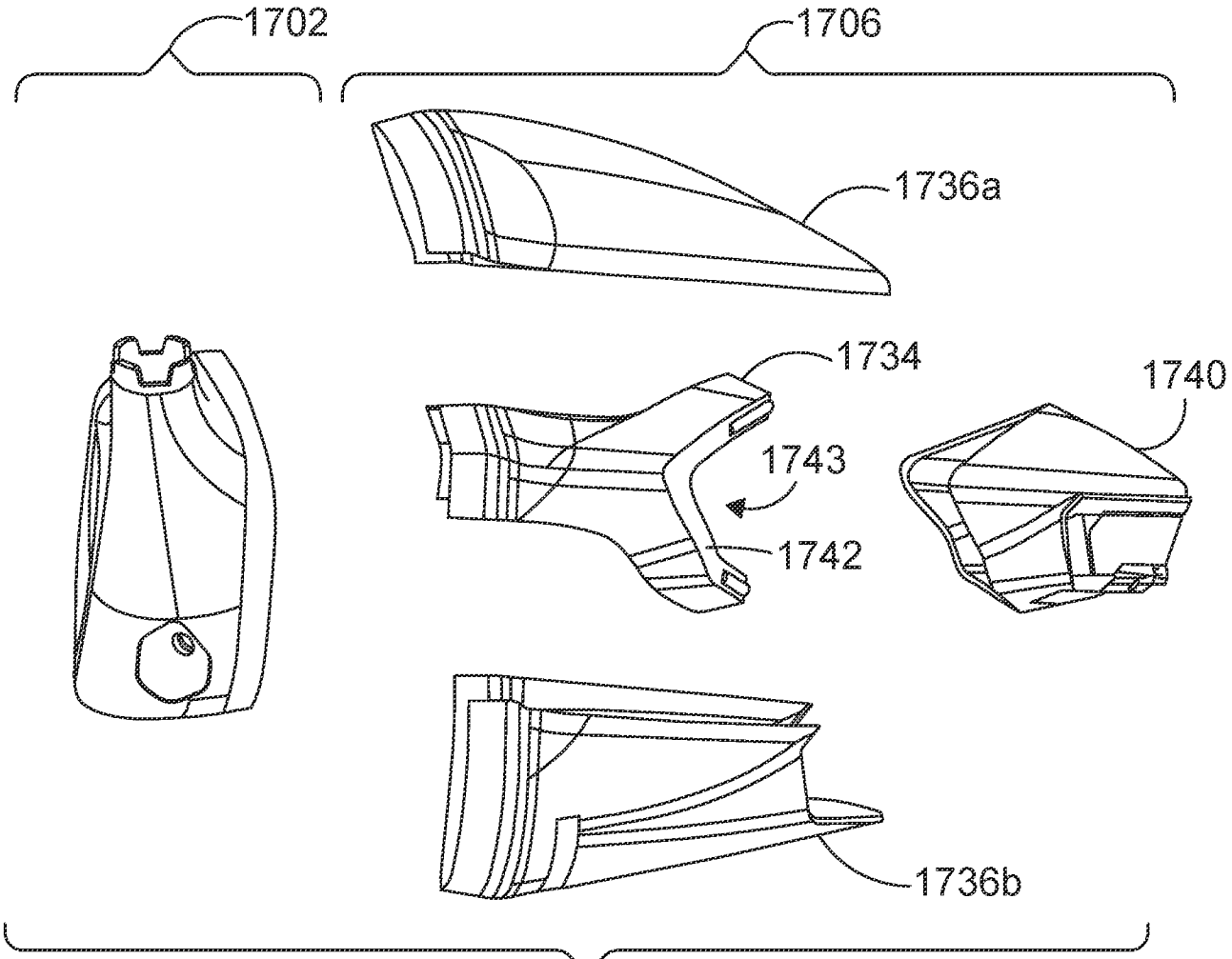
FIG. 17 of the accompanying drawings shows an exploded toe side view of a golf club head in accordance with an even further alternative embodiment of the present invention.
Figure 18:
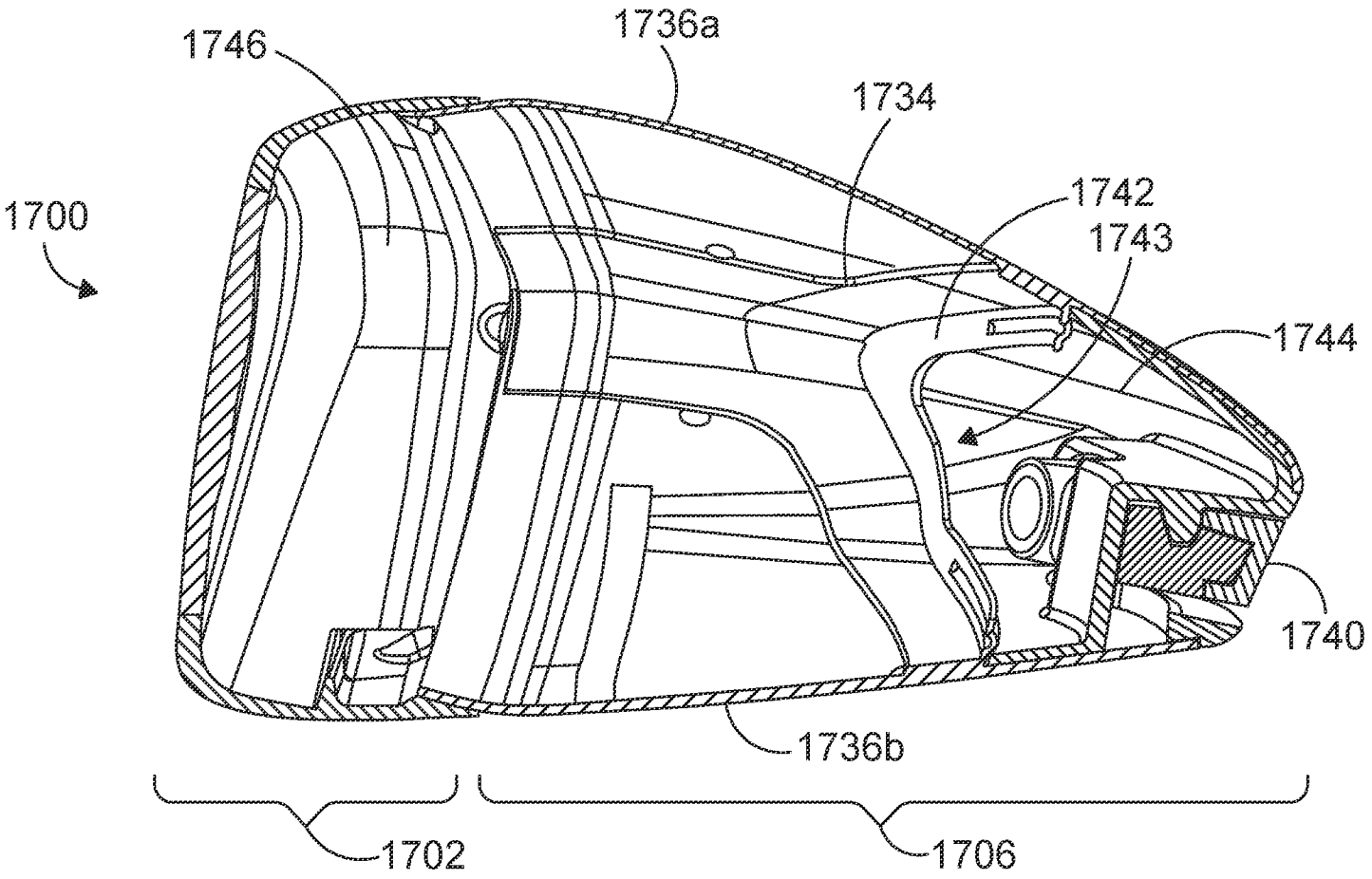
FIG. 18 of the accompanying drawings shows a cross-sectional view of a golf club head in accordance with an even further alternative embodiment of the present invention taken along cross-sectional line A-A' as shown in FIGS. 2 and 11.

FIGS. 17 and 18 of the accompanying drawings shows an exploded and cross-sectional view of a golf club head 1700 in accordance with a further alternative embodiment of the present invention. In this further alternative embodiment of the present invention, all of the elements are similar to previous embodiment shown, but the secondary wall 1643 of the internal ribbon support member 1734 may have an opening 1743 to allow for an adjustment of the acoustic properties of the golf club head 1700. The opening 1743 may help control the acoustic property of the golf club head 1700 by allowing the vibrational energy to travel between the frontal volumetric chamber 1746 and the rear volumetric chamber 1744 to relieve any undesirable vibrations that cause bad sound.

Other than the opening 1743 in the secondary wall 1643 of the internal ribbon support member 1734, the remaining components of the golf club head 1700 are essentially identical. The golf club head 1700 is still comprised out of a frontal striking face portion 1702 and an aft body portion 1706. The lightweight shell 1736 in this embodiment could be further split up into the lightweight crown sub-shell 1736*a* and a lightweight sole sub-shell 1736*b*, and the weighting system 1740 is still attached to the rear portion of the aft body portion 1702.

Figure 19:
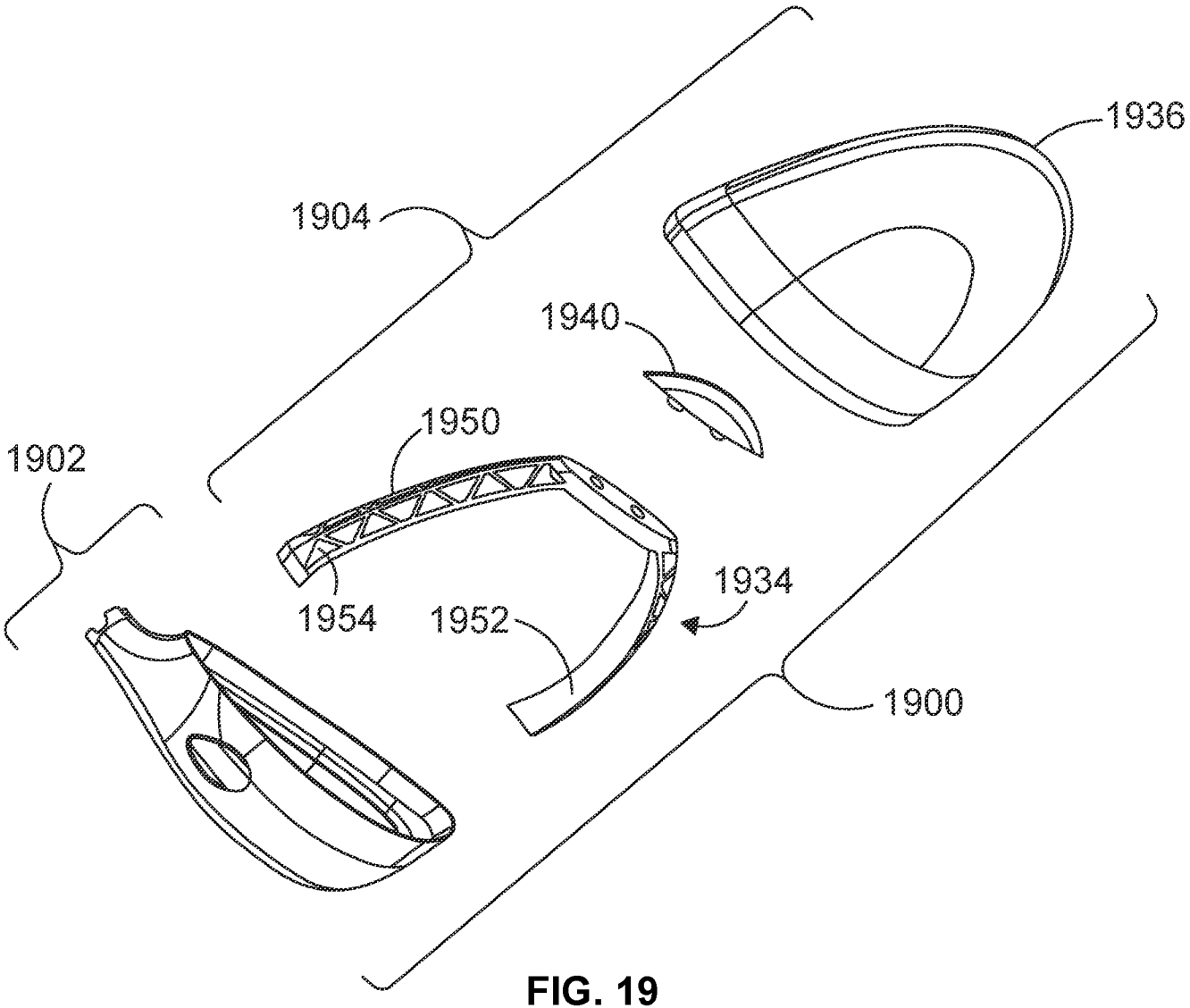
FIG. 19 of the accompanying drawings shows an exploded perspective view of a golf club head in accordance with an even further alternative embodiment of the present invention.

FIG. 19 of the accompanying drawings shows an exploded perspective view of a golf club head 1900 in accordance with a further alternative embodiment of the present invention, wherein the internal ribbon support member 1934 has additional features to help improve the performance of the golf club head 1900 itself. More specifically, only the outer surface 1950, and not the internal component 1952 of the internal ribbon support member 1934 includes the additional features of a plurality of cutouts 1954 to create a lattice structure. The lattice structure, in this current exemplary embodiment of the present invention, may further increase the structural rigidity of the internal ribbon support member 1934, thus further allowing the lightweight shell 1936 to be made even thinner and lighter. In this alternative embodiment of the present invention, the internal ribbon support member may have a mass that is less than between about 7.0 grams, more less than about 6.0 grams, and most preferably less than about 5.0 grams. Other than the internal ribbon support member 1934 being different, all other components of the golf club head 1900 such as the frontal striking face portion 1902, the aft body portion 1904, the lightweight shell 1936, and the weighting system 1940 essentially remain the same.

Figure 20:
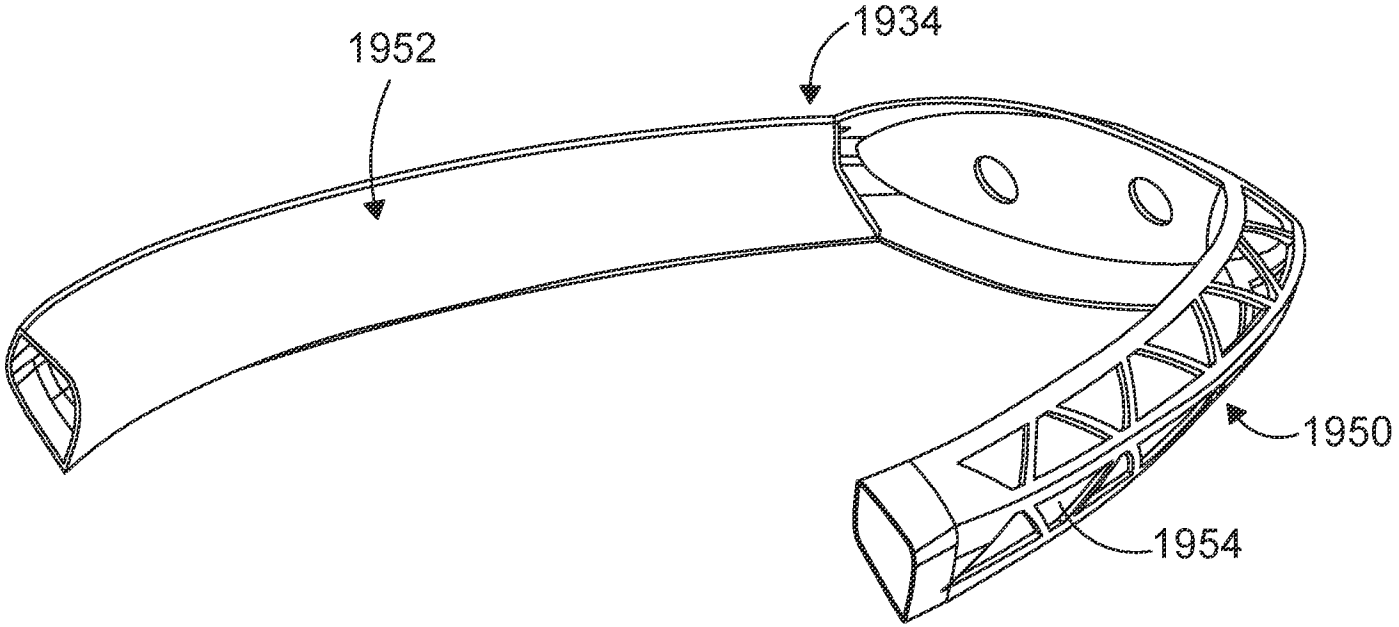
FIG. 20 of the accompanying drawings shows an enlarged view of a internal ribbon support member in accordance with the alternative embodiment of the present invention shown in FIG. 19.

In order to show more details regarding the plurality of cutouts 1954 on the external component 1950 of the internal ribbon support member 1934, an enlarged perspective view of the internal ribbon support member 1934 is shown in FIG. 20. In this enlarged perspective view of the internal ribbon support member 1934 shown in FIG. 20 from a different perspective view allows the difference between the external component 1950 and the internal component 1952 to be shown more clearly. In this FIG. 20, it can be seen that the plurality of cutouts 1954 is only on the external component 1950 and takes on a substantially triangular shape. The pattern of the plurality of cutouts alternate in director lengthwise along the internal ribbon support member 1934 and are mirror images of one another above and below the hemispheric midpoint to create the lattice structure previously mentioned. It should be noted that in alternative embodiments of the present invention, different cutout shapes may be used to form the plurality of cutouts 1954 such as squares, rectangles, ovals, circles, or any other shapes all without departing from the scope and content of the present invention.

In addition to illustrating the plurality of cutouts 1954 along the external component 1954 of the internal ribbon support member 1934, FIG. 20 of the accompanying drawings also illustrates how the external component 1950 and the internal component 1952 of the internal ribbon support member 1934 combine together to create a diamond shaped support member. These types of shapes may generally be preferred in engineering design, as it tends to further increase the structural rigidity of the internal ribbon support member 1934, maximizing the strength to weight ratio of the internal ribbon support member 1934.

Figure 21:
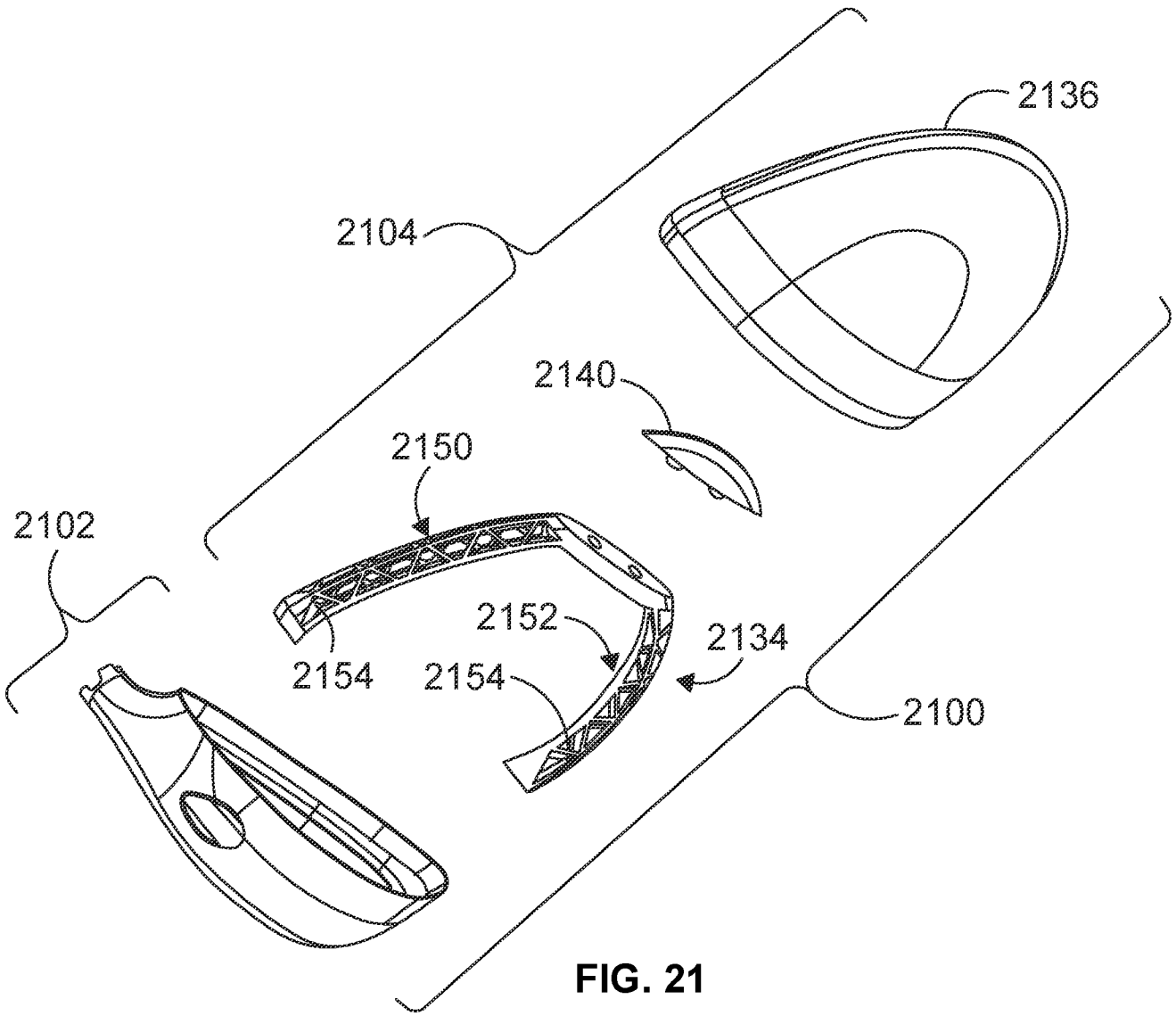
FIG. 21 of the accompanying drawings shows an exploded perspective view of a golf club head in accordance with an even further alternative embodiment of the present invention.
Figure 22:
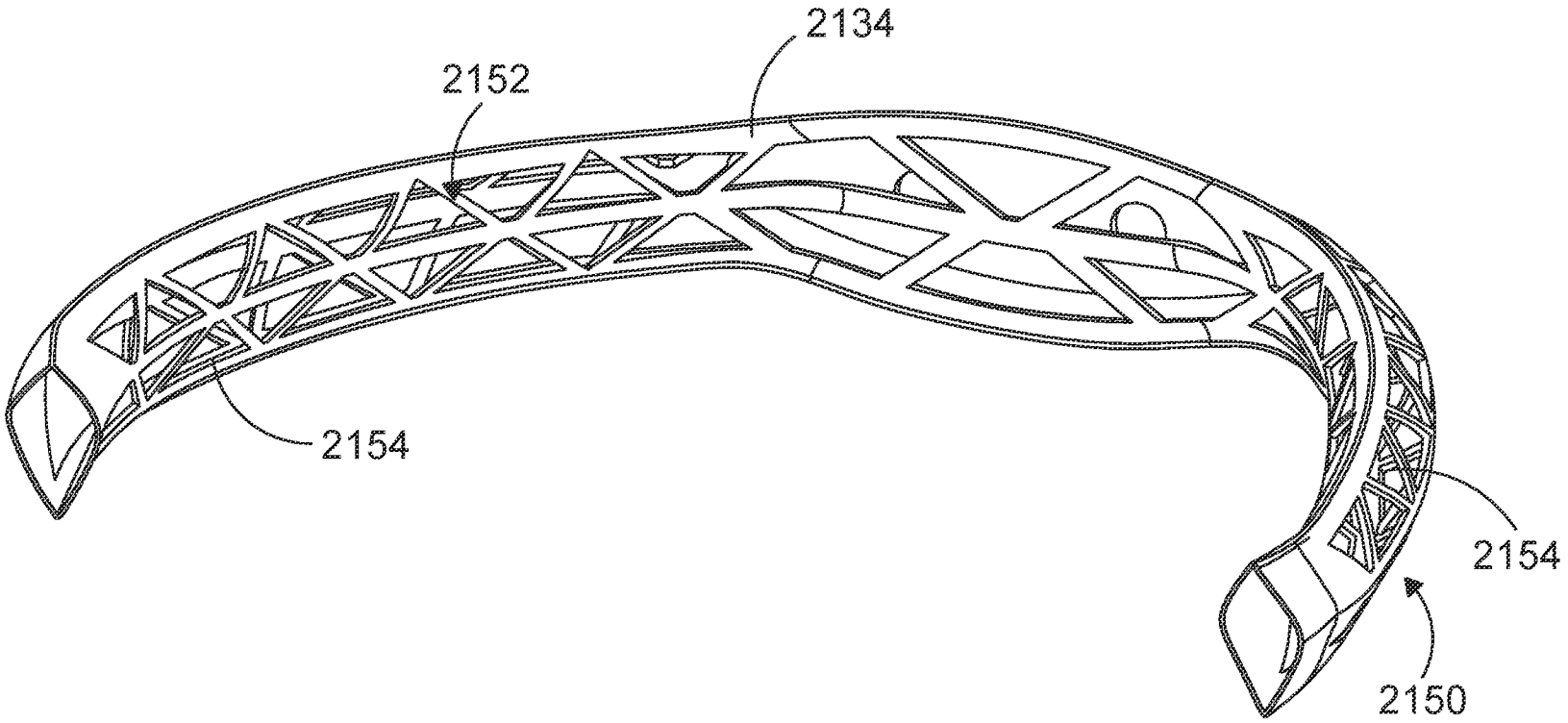
FIG. 22 of the accompanying drawings shows an enlarged view of a internal ribbon support member in accordance with the alternative embodiment of the present invention shown in FIG. 21.

FIGS. 21 and 22 of the accompanying drawings shows an exploded view of a golf club head 2100 and an enlarged perspective view of an internal ribbon support member 2134 respectively to illustrate a different alternative embodiment of the present invention. In this alternative embodiment of the present invention, the golf club head 2100 will still have a striking face portion 2102 and an aft body portion 2104. The aft boy portion 2104 will be further comprised of a lightweight shell 2136, an internal ribbon support member 2134, a weighting system 2140. However, a closer examination of the internal component 2152 of the internal ribbon support member 2134 will highlight the unique feature of this embodiment wherein the internal component 2152 of the internal ribbon support member 2134 will also have a plurality of cutouts 2154 to help further reduce the mass of the internal ribbon support member. Alternatively, it can be said that both the internal component 2152 and the external component 2150 of the internal ribbon support member 2134 both further comprises of a plurality of cutouts 2154. With the additional mass removed from the internal component 2152 of the internal ribbon support member 2134, the internal ribbon support member 2134 in accordance with this embodiment of the present invention may have a total mass of less than about 4.0 grams, more preferably less than about 3.9 grams, and most preferably less than about 3.8 grams.

Figure 23:
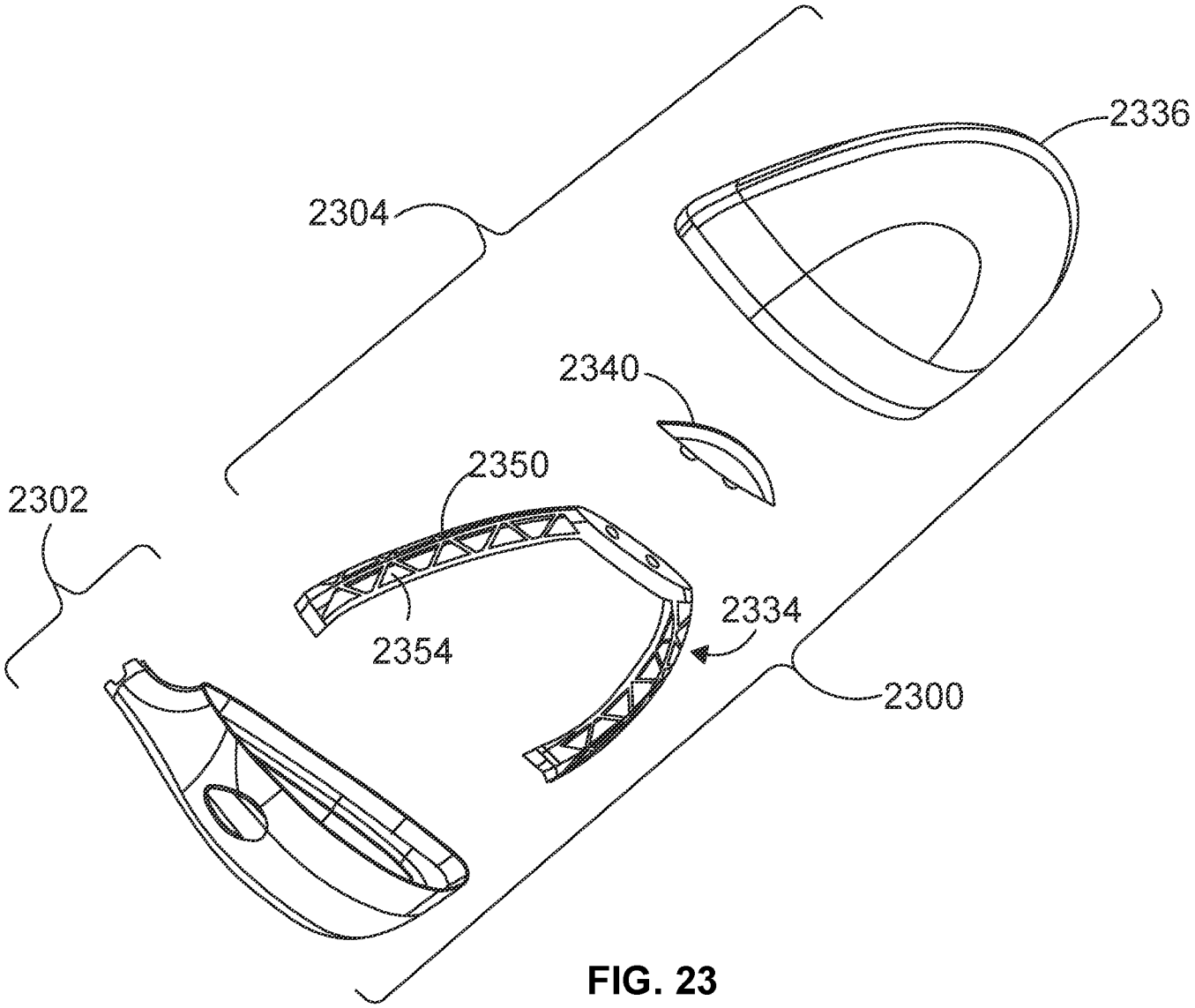
FIG. 23 of the accompanying drawings shows an exploded perspective view of a golf club head in accordance with an even further alternative embodiment of the present invention.
Figure 24:
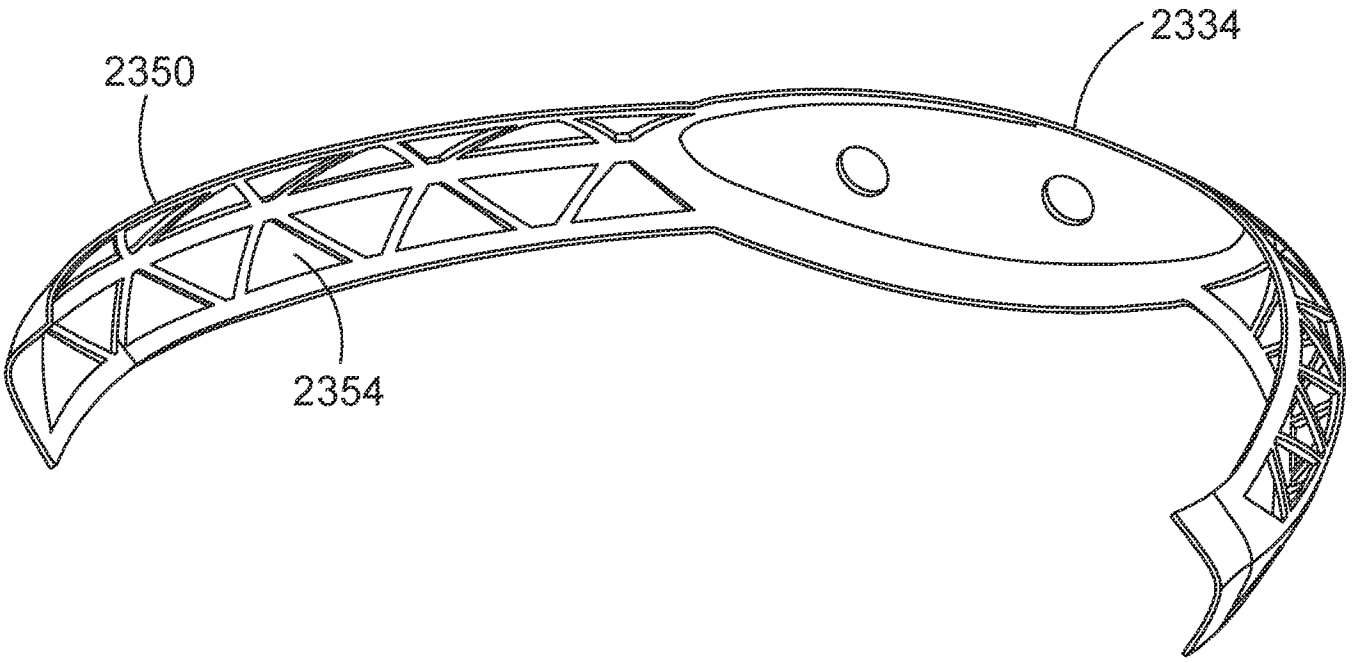
FIG. 24 of the accompanying drawings shows an enlarged view of a internal ribbon support member in accordance with the alternative embodiment of the present invention shown in FIG. 23.

FIGS. 23 and 24 of the accompanying drawings shows an exploded view of a golf club head 2300 and a perspective view of an internal ribbon support member 2334 respectively to illustrate a different alternative embodiment of the present invention. In this alternative embodiment of the present invention, the golf club head 2300 will still have a striking face portion 2302 and an aft body portion 2304. The aft boy portion 2304 will be further comprised of a lightweight shell 2336, an internal ribbon support member 2334, a weighting system 2340. However, in this embodiment, the internal ribbon support member 2334 only has an external component 2350, removing the internal component shown in previous embodiments completely. This embodiment may be desired when a dramatic weight reduction is desired, however, it does come at the expense of reduced structural stiffness support. In this embodiment of the present invention, the internal ribbon support member 2334 may have a total mass less than about 2.8 grams, more preferably less than about 2.7 grams, and most preferably less than about 2.6 grams.

Figure 25:
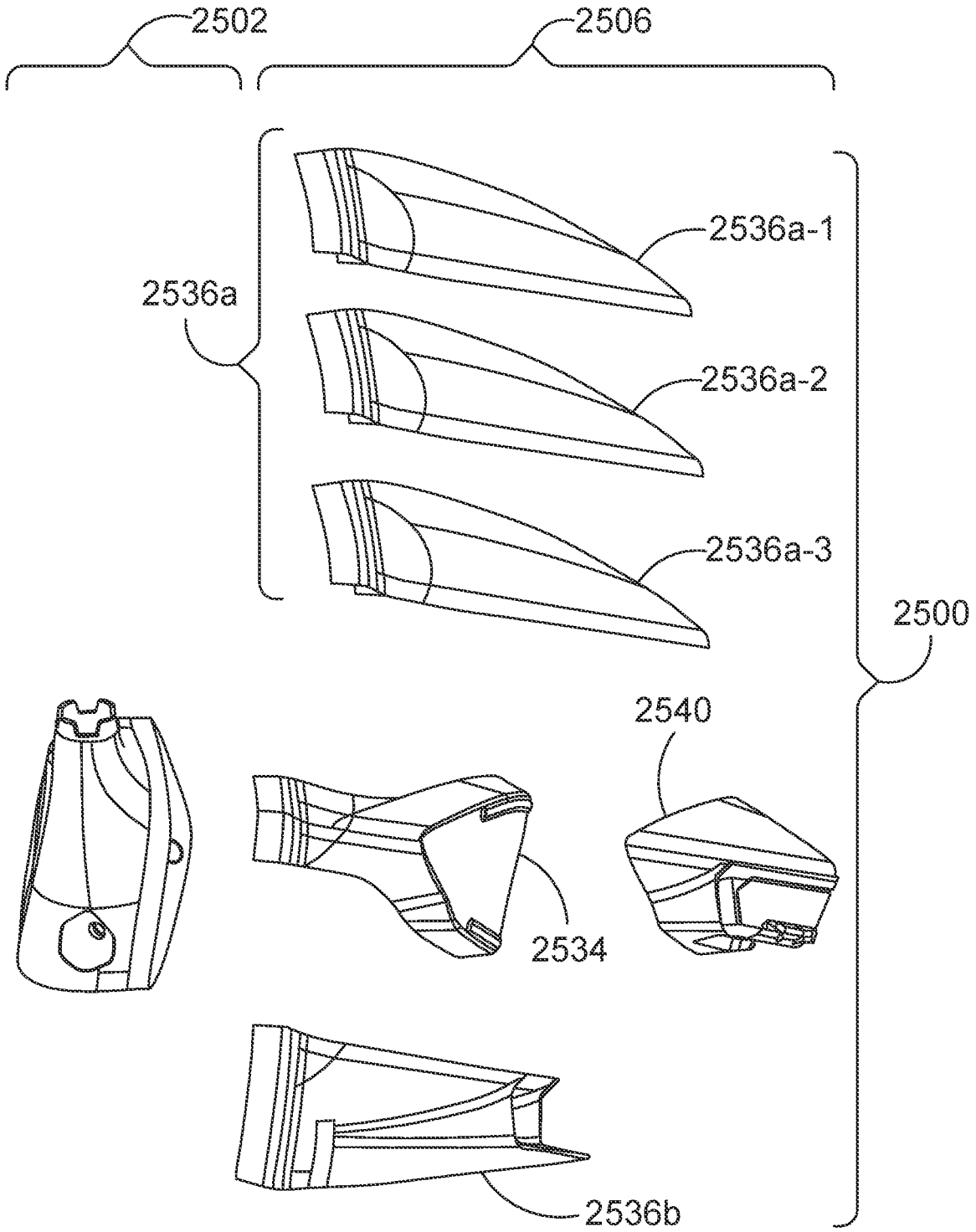
FIG. 25 of the accompanying drawings shows an exploded heel side view of a golf club head in accordance with an even further alternative embodiment of the present invention

FIG. 25 of the accompanying drawings shows an exploded heel side view of a golf club head 2500 in accordance with an even further alternative embodiment of the present invention. In this further alternative embodiment of the present invention, the lightweight crown sub-shell **2536*a* may be further comprised out of three layers to further improve the performance of the golf club head 2500. The golf club head 2500, is very similar to the previous embodiments of the present invention, having a frontal striking face portion 2502 and an aft body portion 2506, wherein the aft body portion 2506 is further comprised of a lightweight crown sub-shell 2536*a*, a lightweight sole sub-shell 2536*b*, an internal ribbon support member 2534, and a weighting system 2540. As previously discussed, the lightweight crown sub-shell 2536*a* in this embodiment of the present invention is further comprised out of three or more layers, having an outer layer 2536*a*-1, a central layer 2536*a*-2, and an internal layer 2536*a*-3. The utilization of the multi-layered construction helps improve the performance of the golf club head 2500 because of the different materials selected to form this lightweight crown sub-shell 2536*a*** can take advantage of each material's inherent properties.

Starting with the most critical layer in the lightweight crown sub-shell **2536*a*, the central layer 2536*a*-2 in accordance with this embodiment of the present invention is generally made out of a semi-crystalline thermoplastic part for its ability to achieve desirable acoustic properties with desirable sound when the golf club head 2500 itself comes into contact with a golf ball. Such semi-crystalline materials may be polyether ether ketone (PEEK), polyphenylene sulfide (PPS), polyacryletherketone (PEAK), and polyetherketoneketone (PEKK) and as previously discussed in U.S. Patent Publication No. 2020/0023247 to Larsen et al. and U.S. Patent Publication No. 2020/0188746 to Sugimae et al., both of which have been previously incorporated by reference in their entirety. Alternatively, the material of the central layer 2536-*a*-2 could also be made out of amorphous materials such as polyetherimide (PEI) polysulfone (PSU), or polyvinyl chloride (PVC) also without departing from the scope and content of the present invention. In this alternative embodiment of the present invention, the central layer 2536*a*-2 comprises of at least one layer of PPS resin having about 80 grams/$m^2$ Fiber Areal Weight (FAW) with about 40% resin content, having a thickness of about 0.10 mm. In a preferred embodiment, the central layer 2536*a*-2 could have two or more layers of between about 5 layers to about 13 layers of PPS resin materials for a total thickness of between about 0.50 mm and 1.30 mm, all without departing from the scope and content of the present invention. In a more preferred embodiment of the present invention, the central layer 2536*a*-2 could have between about 7 layers to about 11 layers of PPS semi-crystalline resin materials having a total thickness of between about 0.70 mm to about 1.10 mm. However, it should be noted that other types of polymer material may be used to form the central layer 2536*a*-2** without departing from the scope and content of the present invention as long as it is capable of producing the desired acoustics frequencies of the golf club previously described.

The PPS material in accordance with the present invention may be a filled PPS or unfilled PPS material that is a semi-crystalline resin material. The filler material, if used, may incorporate continuous or chopped reinforcing fiber. Alternatively, the central layer may be filled or unfilled with the base material in the polysulfides family such as PSU, PES, or PPSU all without departing from the scope and content of the present invention.

Despite the tremendous acoustic benefit associated with semi-crystalline thermoplastic type materials described above, the problem with these types of material is it's inability to bond well to non-resin based materials such as a titanium chassis of a golf club head 2500. The inability to create a strong bond is at least partially due to the fact that the resin of semi-crystalline thermoplastic type material is generally chemically resistant to solvents. Another downside of semi-crystalline thermoplastic type material is that the resin is generally clear, thus allowing the underlying fiber to be shown; and it tends to create a relatively dull finish. In order to address these drawbacks, the present invention utilizes a three layered construction, wherein the outer layer **2536*a*-1 is made out of a material capable of addressing the cosmetic deficiencies of the semi-crystalline thermoplastic type material, and the internal layer 2536*a*-3** is made out of material capable of addressing the bonding deficiencies of the semi-crystalline thermoplastic type material.

Moving onto the outer layer **2536*a*-1 of the lightweight crown sub-shell 2536*a*, it should be noted that the outer layer 2536*a*-1 shown here is generally made out of a polyetherimide (PEI) polymer resin film having a thickness of less than about 0.10 mm, more preferably less than about 0.08 mm, and most preferably less than about 0.06 mm. This utilization of the PEI polymer resin film to form the outer layer 2536*a*-1 can provide a finished product that is cosmetically appealing, without the need to paint the lightweight crown sub-shell 2536*a*** in a secondary post processing step.

Finally, the inner layer **2536*a*-3 of the lightweight crown sub-shell 2536*a* in accordance with the current embodiment of the present invention may also be made out of a PEI polymer resin film material having a thickness of less than about 0.10 mm, more preferably less than about 0.08 mm, and most preferably less than about 0.06 mm. This utilization of the PEI polymer resin film to form the inner layer 2536*a*-3 can provide a nice intermediary bonding layer between the multiple layers of PPS resin and other non-resin based material used to form the chassis of the golf club head 2500. In one exemplary embodiment of the present invention, a DP420 NS type epoxy may be used to bond the entirety of the lightweight crown sub-shell 2536** formed of the three layered sandwiched material to the chassis without departing from the scope and content of the present invention.

It should be noted that although FIG. 25 of the accompanying drawings shows the lightweight crown sub-shell **2536*a* being a three layered composition, the central layer 2536*a*-2 could be formed out of multiple layers of PPS resin material with different fiber orientations without departing from the scope and content of the present invention. In addition to the above, this multi-layered formation of the lightweight crown sub-shell 2536*a* could also be used to form the lightweight sole sub-shell 2536*b*, or even the internal ribbon support member 2534** also without departing from the scope and content of the present invention.

Other than in the operating example, or unless otherwise expressly specified, all of the numerical ranges, amounts, values and percentages such as those for amounts of materials, moment of inertias, center of gravity locations, loft, draft angles, various performance ratios, and others in the aforementioned portions of the specification may be read as if prefaced by the word "about" even though the term "about" may not expressly appear in the value, amount, or range. Accordingly, unless indicated to the contrary, the numerical parameters set forth in the above specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. A golf club head comprising:

a frontal striking face portion located at a frontal portion of said golf club head; and an aft body portion, attached to the rear of said striking face portion;

wherein the aft body portion further comprises a lightweight shell, wherein said lightweight shell further comprises a lightweight crown sub-shell, and wherein said lightweight crown sub-shell further comprises:

an outer layer, a central layer, and an internal layer, wherein said outer layer and said central layer are made from different materials, wherein said internal layer and said central layer are made from different materials, wherein said central layer further comprises two or more layers of a semi-crystalline resin material, and wherein both said outer layer and said internal layer are formed from a polyetherimide (PEI) film having a thickness of less than about 0.10 mm.

2. The golf club head of claim 1, wherein said central layer further comprises between about 5 layers and about 13 layers of said semi-crystalline resin material.

3. The golf club head of claim 2, wherein said central layer further comprises between about 7 layers and about 11 layers of said semi-crystalline resin material.

4. The golf club head of claim 1, wherein said central layer is formed from a polyphenylene sulfide (PPS) material.

5. The golf club head of claim 1, wherein said PEI film has a thickness of less than about 0.08 mm.

6. The golf club head of claim 5, wherein said PEI film has a thickness of less than about 0.06 mm.

7. A golf club head comprising:

a frontal striking face portion located at a frontal portion of said golf club head; and an aft body portion, attached to the rear of said striking face portion;

wherein the aft body portion further comprises a lightweight shell, wherein said lightweight shell further comprises a lightweight crown sub-shell, and wherein said lightweight crown sub-shell further comprises:

an outer layer made from a polyetherimide (PEI) film, a central layer made from polyphenylene sulfide (PPS) resin material, and an internal layer made from a polyetherimide (PEI) film, wherein said PPS resin material contains reinforcing fiber and has a Fiber Areal Weight (FAW) of about 80 grams/$m^2$, wherein said PPS resin material has about 40% resin content, and wherein said PPS resin material has an individual layer thickness of about 0.10 mm.

8. The golf club head of claim 7, wherein said central layer further comprises between about 5 layers and about 13 layers of said PPS resin material for a total thickness of between about 0.50 mm and 1.30 mm.

9. The golf club head of claim 8, wherein said central layer further comprises between about 7 layers and about 11 layers of said PPS resin material for a total thickness of between about 0.70 mm and 1.10 mm.

* * * * *